United States Patent [19]

Hinata et al.

[11] 4,018,610

[45] Apr. 19, 1977

[54] SUPERSENSITIZED SILVER HALIDE PHOTOGRAPHIC EMULSION

[75] Inventors: Masanao Hinata; Haruo Takei; Akira Sato; Tadashi Ikeda, all of Minami-ashigara, Japan

[73] Assignee: Fuji Photo Film Co., Ltd., Minami-ashigara, Japan

[22] Filed: July 28, 1975

[21] Appl. No.: 599,517

[30] Foreign Application Priority Data

July 26, 1974 Japan ..... 49-86201

[52] U.S. Cl. ..... 96/124; 96/3; 96/29 R; 96/82; 96/74; 96/95; 96/114.1; 96/132; 96/119 PQ

[51] Int. Cl.[2] ..... G03C 1/14

[58] Field of Search ..... 96/124, 132, 95, 74

[56] References Cited

UNITED STATES PATENTS

| | | | |
|---|---|---|---|
| 2,701,198 | 2/1955 | Carroll et al. | 96/124 |
| 3,038,800 | 6/1962 | Luckey et al. | 96/124 |
| 3,432,303 | 3/1969 | Jones et al. | 96/124 |
| 3,667,960 | 6/1972 | Shiba et al. | 96/124 |
| 3,717,468 | 2/1973 | Sakazume et al. | 96/124 |
| 3,752,670 | 8/1973 | Needler et al. | 96/132 |
| 3,847,613 | 11/1974 | Sakazume et al. | 96/132 |

*Primary Examiner*—J. Travis Brown
*Attorney, Agent, or Firm*—Sughrue, Rothwell, Mion, Zinn & Macpeak

[57] ABSTRACT

A spectrally sensitized silver halide photographic emulsion containing, in combination, supersensitizing amounts of at least one sensitizing dye represented by the following general formula (I):

(I)

$(X_{(1)}^-)_{m-1}$ wherein $Z^1$ and $Z^2$ each represents an atomic group necessary for completing a benzimidazole nucleus, an oxazole nucleus, a benzoxazole nucleus, a naphthoxazole nucleus, a thiazole nucleus, a benzothiazole nucleus, a naphthothiazole nucleus, a selenazole nucleus, a benzoselenazole nucleus or a naphthoselenazole nucleus excepting that both of $Z^1$ and $Z^2$ do not simultaneously represent an atomic group necessary for completing an oxazole nucleus, a benzoxazole nucleus or a naphthoxazole nucleus; $R^1$ and $R^2$ each represents an aliphatic group which may be substituted and the carbon chain of which may be interrupted with an oxygen atom or a sulfur atom; $R^0$ represents a hydrogen atom, an alkyl group or an aralkyl group; $X_{(1)}^-$ represents an anion; and m is 1 or 2, with m being 1 when the dye forms an intramolecular salt; and at least one sensitizing dye represented by the following general formula (II):

(II)

$(X_{(2)}^-)_{n-1}$ wherein $Z^3$ and $Z^4$ each represents an atomic group necessary for completing a pyrroline nucleus, a pyridine nucleus, an indolenine nucleus, a benzimidazole nucleus, an oxazole nucleus, a benzoxazole nucleus, a naphthoxazole nucleus, a thiazoline nucleus, a thiazole nucleus, a benzothiazole nucleus, a naphthothiazole nucleus, a selenazole nucleus, a benzoselenazole nucleus, or a naphthoselenazole nucleus; $R^3$ and $R^4$ each represents an aliphatic group which may be substituted and the carbon chain of which may be interrupted with an oxygen atom or a sulfur atom, and at least one of $R^3$ and $R^4$ represents an aliphatic group containing a hydroxy group, a carboxy group or a sulfo group; $X_{(2)}^-$ represents an anion; and n is 1 or 2, with n being 1 when the dye forms an intramolecular salt.

20 Claims, 12 Drawing Figures

SUPERSENSITIZED SILVER HALIDE PHOTOGRAPHIC EMULSION

BACKGROUND OF THE INVENTION

1. Field of the Invention

This invention relates to a silver halide photographic emulsion, and more particularly to a silver halide photographic emulsion which is spectrally sensitized with a combination of a red- or green-sensitizing dye with a blue-sensitizing dye in which the combination of both dyes exhibits a supersensitizing effect on each other.

2. Description of the Prior Art

In silver halide photographic light-sensitive materials having panchromatic spectral sensitivity characteristics, a thiacarbocyanine dye or a selenacarbocyanine dye is frequently used as sensitizing dye for the spectral sensitization of a silver halide photographic emulsion. However, panchromatic photographic light-sensitive materials sometimes require further spectral sensitization to blue light ranging from wavelengths shorter than 500 nm to wavelengths longer than the inherent light-sensitive wavelength region of the silver halide. For example, this is required for panchromatic photographic light-sensitive materials used for three-color separation photographing in the plate making process for printing. For this purpose, it is known to use an apomerocyanine and/or a dimethinemerocyanine dye together with the above thiacarbocyanine or selenacarbocyanine dye (for example, as disclosed in U.S. Pat. No. 3,808,009). However, the combined use of such a merocyanine dye with a thiacarbocyanine or selenacarbocyanine dye often results in a reduction in sensitivity to red light. In particular, when the above merocyanine dye and carbocyanine dye are stored as a mixed solution and then used in the production of light-sensitive materials, there are tendencies toward a reduction in the sensitivity of the photographic emulsion and toward the occurrence of fog. In the practical production process, the addition of two or more different dyes as a mixed solution thereof can be used to reduce the amount of a solvent used for dissolving the dyes, and simplifies the facilities required and process control needed as compared with the addition thereof as separate solutions. Therefore, discovery of a combination of sensitizing dyes which are stable also in the form of a mixed solution thereof has been desired.

On the other hand, the spectral sensitivity characteristics, particularly the spectral sensitization maximum wavelength of a photographic emulsion layer is important in photographic light-sensitive materials. In color negative photographic light-sensitive materials used for photography or color reversal photographic light-sensitive materials, the sensitization maximum wavelength of the red-sensitive layer is adjusted to an appropriate value in order to obtain the desired color reproducibility, considering the relation thereof with the spectral characteristics of the blue-sensitive layer and the green-sensitive layer. For example, a styryl dye which itself scarcely provides any spectral sensitization is used together with a carbocyanine dye having a red-sensitizing effect. For example, the combinations as described in U.S. Pat. Nos. 3,615,635 and 2,533,426 can be used, by which the sensitization maximum is shifted to a shorter wavelength than that obtained with the use of the carbocyanine dye alone. However, styryl dyes have a relatively low supersensitizing effect when combined with a carboxyanine dye. If the styryl dye is added in an amount sufficient to shift the sensitization maximum to a shorter wavelength, the red-sensitivity is reduced in most cases. In addition, many styryl dyes are unstable, so that care must be taken in handling solutions of these dyes.

SUMMARY OF THE INVENTION

A first object of this invention is to provide a silver halide photographic emulsion which is spectrally sensitized so as to exhibit high red-sensitivity.

A second object of this invention is to provide a silver halide photographic emulsion which is highly spectrally sensitized to the red wavelength region and the blue wavelength region.

A third object of this invention is to provide a silver halide photographic emulsion which is highly spectrally sensitized to the green wavelength region and the blue wavelength region.

Another object of this invention is to provide a silver halide photographic emulsion which is highly spectrally sensitized to the red wavelength region, the green wavelength region and the blue wavelength region.

A further object of this invention is to provide a silver halide photographic emulsion which is highly spectrally sensitized to the blue wavelength region and at least one of the red wavelength region and the green wavelength region by using a combination of sensitizing dyes, a solution of which has good stability with time.

A still further object of this invention is to provide a silver halide photographic emulsion having a color sensitivity suitable for preparing black and white light-sensitive materials having good color sensitivity or suitable for preparing color light-sensitive materials having good color reproducibility.

The above objects of this invention are accomplished with a silver halide photographic emulsion containing supersensitizing amounts of at least one sensitizing dye represented by the following general formula (I)

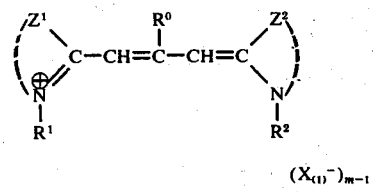

(I)

wherein $Z^1$ and $Z^2$ each represents an atomic group necessary for completing a benzimidazole nucleus, an oxazole nucleus, a benzoxazole nucleus, a naphthoxazole nucleus, a thiazole nucleus, a benzothiazole nucleus, a naphthothiazole nucleus, a selenazole nucleus, a benzoselenazole nucleus or a naphthoselenazole nucleus excepting that both of $Z^1$ and $Z^2$ do not simultaneously represent an oxazole nucleus, a benzoxazole nucleus or a naphthoxazole nucleus; $R^1$ and $R^2$ each represents an aliphatic group and the carbon chain of which may be interrupted with an oxygen atom or a sulfur atom; $R^0$ represents a hydrogen atom, an alkyl group or an aralkyl group; $X_{(1)}^-$ represents an anion; and m is 1 or 2, with m being 1 when the dye forms an intramolecular salt; and at least one sensitizing dye represented by the following general formula (II)

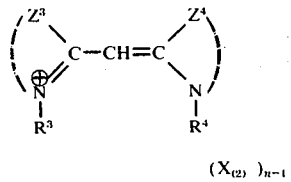

(II)

wherein $Z^3$ and $Z^4$ each represents an atomic group necessary for completing a pyrroline nucleus, a pyridine nucleus, an indolenine nucleus, a benzimidazole nucleus, an oxazole nucleus, a benzoxazole nucleus, a naphthoxazole nucleus, a thiazoline nucleus, a thiazole nucleus, a benzothiazole nucleus, a naphthothiazole nucleus, a selenazole nucleus, a benzoselenazole nucleus or a naphthoselenazole nucleus; $R^3$ and $R^4$ each represents an aliphatic group and the carbon chain of which may be interrupted with an oxygen atom or a sulfur atom, and at least one of $R^3$ and $R^4$ represents an aliphatic group containing a hydroxy group, a carboxy group or a sulfo group; $X_{(2)}^-$ represents an anion; and n is 1 or 2, with n being 1 when the dye forms an intramolecular salt.

BRIEF DESCRIPTION OF THE ACCOMPANYING DRAWINGS

DETAILED DESCRIPTION OF THE INVENTION

Figure 1:
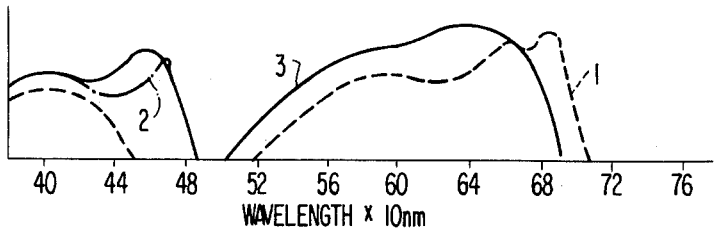
FIG. 1 to FIG. 11 show the spectral sensitivity curves obtained with the sensitizing dyes of this invention and comparative dyes. The numbers given for the curves in each figure correspond to the numbers given in the spectrogram column at the right side of Table 1 to Table 5.

In the above formula (I), $Z^1$ and $Z^2$ each represents an atomic group necessary for forming a benzimidazole nucleus, an oxazole nucleus, a benzoxazole nucleus, a naphthoxazole nucleus, a thiazole nucleus, a benzothiazole nucleus, a naphthothizole nucleus, a selenazole nucleus, a benzoselenazole nucleus or a naphthoselenazole nucleus. however, both nuclei formed by $Z^1$ and $Z^2$ are not both an oxazole nucleus, both a benzoxazole nucleus or both a naphthoxazole nucleus simultaneously. Examples of the above naphthoxazole, naphthothiazole and naphthoselenazole nuclei include naphtho[1,2-d]oxazole, naphtho[2,1-d]oxazole, naphtho[1,2-d]thiazole, naphtho[2,1-d]thiazole, naphtho[2,3-d]-thiazole, naphtho[1,2-d]selenazole and naphtho[2,1-d]selenazole nuclei.

The aromatic rings of these nuclei can be substituted with various substitutents. Examples of suitable substituents are one or more of a halogen atom (such as a chlorine, bromine or fluorine atom); an alkyl group having up to 4 carbon atoms (such as a methyl, ethyl, isopropyl, 3-propyl or butyl group); a cyano group; a carboxy group; an alkoxycarbonyl group having up to 4 carbon atoms (such as an ethoxycarbonyl group); an alkylcarbonyl group having up to 4 carbon atoms (such as an acetyl group); an alkylsulfonyl group having up to 4 carbon atoms (such as a methylsulfonyl group); an aryl group (such as a phenyl or p-tolyl group); a haloalkyl group (such as a trifluoromethyl group); a hydroxy group; an alkoxy group having up to 4 carbon atoms (such a methoxy or ethoxy group); and an alkylcarbonylamino group having up to 4 carbon atoms (such as an acetamido group). The nitrogen atom in the 1-position of the benzimidazole nucleus can be substituted with an alkyl group having up to 4 carbon atoms (such as a methyl, ethyl or propyl group), an alkenyl group having up to 4 carbon atoms (such as an allyl group) or an aromatic hydrocarbon group (such as a phenyl group).

$R^1$ and $R^2$ each representa an aliphatic hydrocarbon group having up to 8 carbon atoms which may be substituted and the carbon chain of which may be interrupted with an oxygen atom, a sulfur atom, etc.

$R^0$ represents a hydrogen atom, an alkyl group having up to 3 carbon atoms (such as a methyl, ethyl or propyl group), or an aralkyl group having up to 8 carbon atoms (such as a phenethyl group).

$X_{(1)}^-$ represents an acid anion, and m is 1 or 2, with m being 1 when the dye forms an intramolecular salt.

In the above formula (II), $Z^3$ and $Z^4$ each represents an atomic group necessary for completing a pyrroline nucleus, a pyridine nucleus, a thiazoline nucleus, an oxazole nucleus, a thiazole nucleus, a selenazole nucleus, an indolenine nucleus, a benzimidazole nucleus, a benzoxazole nucleus, a benzothiazole nucleus, a benzoselenazole nucleus, a naphthoxazole nucleus, a naphthothiazole nucleus, or a naphthoselenazole nucleus. Examples of the naphthoxazole nucleus include naphtho[1,2-d]oxazole and naphtho[2,1-d]oxazole nuclei, of the naphthothiazole nucleus include naphtho[1,2-d]thiazole, naphtho[2,1-d]thiazole and naphtho[2,3-d]thiazole nuclei, and of the naphthoselenazole nucleus include naphtho[1,2-d]selenazole and naphtho[2,1-d]selenazole nuclei. The aromatic hydrocarbon rings contained in these nuclei may have various substituents. Suitable substituents are the same as those described above for the aromatic hydrocarbon rings of the nuclei for $Z^1$ and $Z^2$. The carbon atom in the 3-position of the indolenine nucleus may be substituted with a lower alkyl group having up to 3 carbon atoms (such as a methyl group).

At least one of $R^3$ and $R^4$ represents an aliphatic group having up to 8 carbon atoms which is substituted with a hydroxy group, a carboxy group or a sulfo group, and the other represents an aliphatic group having up to 8 carbon atoms. These aliphatic groups may have further substituents such as a hydroxy group, an acetoxy group, etc., and the carbon chain of the aliphatic groups may be interrupted with an oxygen atom or sulfur atom.

$X_{(2)}^-$ represents an acid anion, and n is 1 or 2, with n being 1 when the dye forms an intramolecular walt.

More particularly, in the sensitizing dyes represented by the general formula (I) or (II) used in this invention, specific examples of the heterocyclic nuclei formed by $Z^1$ or $Z^2$ include 1-methyl-5-chlorobenzimidazole, 1-methyl-5-fluorobenzimidazole, 1-methyl-5,6-dichlorobenzimidazole, 1-methyl-5,6-difluorobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5,-fluorobenzimidazole, 1-allyl-5,6-dichlorobenzimidazole, 1-allyl-5,6-difluorobenzimidazole, 1-ethyl-5-methoxycarbonylbenzimidazole, 1-ethyl-5-methylsulfonylbenzimidazole, 1-phenyl-5-chlorobenzimidazole, 1-phenyl-5-fluorobenzimidazole, 1-phenyl-5,6-dichlorobenzimidazole, 1-phenyl-5,6-difluorobenzimidazole, 1-ethyl-5-trifluoromethylbenzimidazole; oxazole, 4-methyloxazole, 5-methyloxazole, 4,5-dimethyloxazole, 4-p-trifluorooxazole, benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole, 5-hydroxybenzoxazole, naphtho[1,2-d]oxazole; thiazole, 4-methylthiazole, 4-phenylthiazole, 4,5-dimethylthiazole, 4-methyl-5-phenylthiazole, benzothiazole, 5-chlorobenzothiazole, 5-bromobenzothiazole, 5-methylbenzothiazole, 5-methoxybenzothiazole, 5-ethoxybenzothiazole, 6-methylbenzothiazole, 6-chlorobenzothiazole, 5-carboxybenzothiazole, 5-acetylbenzothiazole, 5-methoxycarbonylbenzothiazole, 5-hydroxybenzothiazole, 5-trifluoromethylbenzothiazole, 5-cyanobenzothiazole, 5,6-dimethylbenzothiazole, 5-acetylaminobenzothiazole, 6-methoxybenzothiazole, 5,6-dimethoxybenzothiazole, 5,6-dichlorobenzothiazole, naphtho[1,2-d]thiazole; selenazole, 4-methylselenazole, 4phenylselenazole, 4,5-dimethylselenazole, benzoselenazole, 5-chlorobenzoselenazole, 5-bromobenzoselenazole, 5-methylbenzoselenazole, 5-methoxybenzoselenazole, 5,6-dimethylbenzoselenazole, naphtho[1,2-d]selenazole, and the like.

Specific examples of the heterocyclic nuclei formed by $Z^3$ or $Z^4$ include the nuclei described above for $Z^1$ and $Z^2$, as well as pyrroline, thiazoline, pyridine, 3,3-dimethylindolenine, 3,3,6-trimethylindolenine, 6-chloro-3,3-dimethylindolenine and 3,3,5,6-tetramethylindolenine nuclei.

Specific examples of the groups represented by $R^1$, $R^2$, $R^3$ and $R^4$ in the above general formulas (I) and (II) include methyl, ethyl, propyl, butyl, 2-methoxyethyl, 2-ethylthioethyl, 2-hydroxyethyl, 3-hydroxypropyl, 4-hydroxybutyl, 2-carboxyethyl, 3-carboxypropyl, 4-carobxybutyl, 3-carboxybutyl, 2-(2-carboxyethoxy)ethyl, 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl and vinylmethyl groups.

The acid anions represented by $X_{(1)}^-$ and $X_{(2)}^-$ include acid anions used for conventional cyanine dye salts, such as iodide, bromide, chloride, p-toluenesulfonate, benzensulfonate, sulfate, perchlorate or rhodanate ions.

Of the compounds represented by the above general formula (I), particularly useful compounds are represented by the following general formulas (I-1) and (I-2).

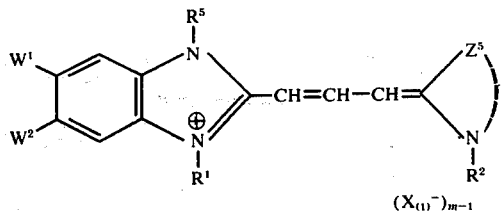

(I-1)

In this formula, $W^1$ and $W^2$ each represents a hydrogen atom, a halogen atom (such as a chlorine or bromine atom), a trifluoromethyl group, a cyano group, a carboxy group, or an alkoxycarbonyl group (such as an ethoxycarbonyl group).

$Z^5$ represents an atomic group necessary for completing a benzoxazole, naphtho[1,2-d]oxazole, benzothiazole, naphtho[1,2-d]thiazole, benzoselenazole, naphtho[1,2-d]selenazole or benzimidazole nucleus.

$R^5$ represents an alkyl group having up to 8 carbon atoms (such as a methyl, ethyl or propyl group). $R^1$, $R^2$, $X_{(1)}^-$ and m each has the same meanings as in the general formula (I).

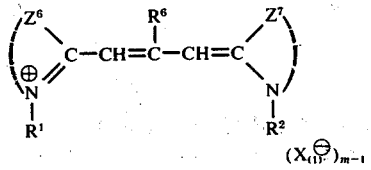

(I-2)

In this formula, $Z^6$ nd $Z^7$ each represents an atomic group necessary for completing a benzoxazole, naphtho[1,2-d]oxazole, benzothiazole, naphtho[1,2-d]thiazole, benzoselenazole or naphtho[1,2-d]selenazole nucleus. However, both the nucleus formed through $Z^6$ and the nucleus formed through $Z^7$ do not represent at the same time a benzoxazole or naphtho[1,2-d]oxazole nucleus. $R^6$ represents a hydrogen atom, a methyl group, an ethyl group, or an n- or iso-propyl group. $R^1$, $R^2$, $X_{(1)}^-$ and m each has the same meanings as in the general formula (I).

Of the compounds represented by the general formulas (I-1) and (I-2), particularly advantageous compounds are represented by the following general formulas (I-3) to (I-6).

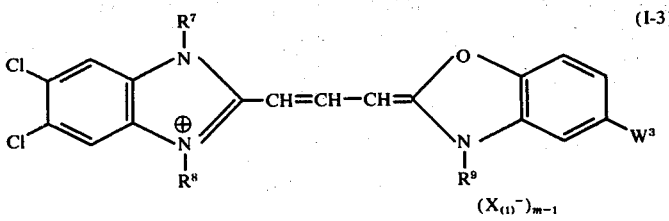

(I-3)

In this formula, $W^3$ represents a chlorine atom, a bromine atom, a fluorine atom or a phenyl group, and $R^8$ and $R^9$ each represents a hydroxyalkyl group (such as a β-hydroxyethyl or β-hydroxypropyl group), a carboxyalky group (such as a carboxymethyl, β-carboxyethyl or γ-carboxypropyl group), or a sulfoalkyl group (such as a β-sulfoethyl, γ-sulfopropyl, γ-sulfobutyl or δ-sulfobutyl group). $R^7$ has the same meanings as in the general formula (I-1), and $X_{(1)}^-$ and m each has the same meanings as in the general formula (I).

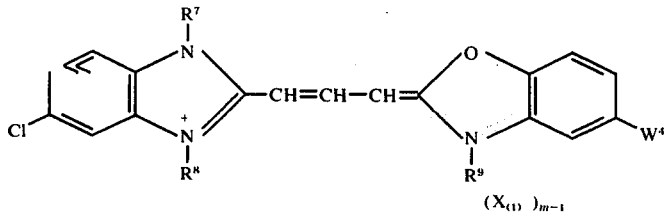

(I-4)

In this formula, $W^4$ represents a chlorine atom, a bromine atom, a fluorine atom, a methyl group, an ethyl group, a methoxy group, an ethoxy group or a phenyl group. $R^8$ and $R^9$ each has the same meanings as in the general formula (I-3), and $R^7$ has the same meanings as in the general formula (I-1).

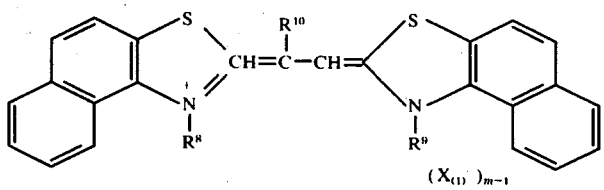

(I-5)

In this formula, $R^8$ and $R^9$ each has the same meanings as in the general formula (I-3). $R^{10}$ represents a methyl group or an ethyl group.

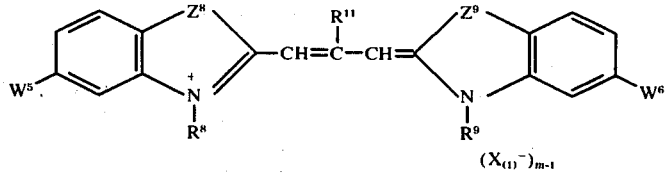

In this formula, $Z^8$ and $Z^9$ each represents a sulfur atom or a selenium atom, and preferably a sulfur atom. $W^5$ and $W^6$ each represents a hydrogen atom, a chlorine atom, a bromine atom, a methyl group, an ethyl group, a methoxy group or an ethoxy group. $R^8$ and $R^9$ each has the same meanings as in the general formula (I-3). $R^{11}$ represents a methyl group, an ethyl group or a propyl group.

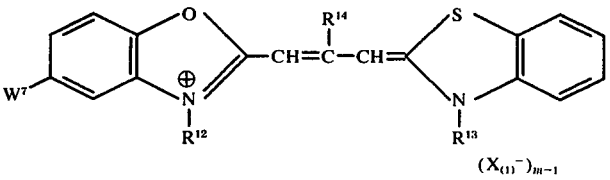

(I-7)

In this formula, $W^7$ represents a hydrogen atom, a chlorine atom, a bromine atom, a methyl group, an ethyl group, a methoxy group or an ethoxy group. $R^{12}$ and $R^{13}$ each represents a methyl group or an ethyl group, or each has the same meanings as $R^8$ and $R^9$ in the general formula (I-3). $R^{14}$ represents a methyl group, an ethyl group or a propyl group.

Of the compounds represented by the general formula (II), particularly useful compounds are represented by the following general formula (II-1).

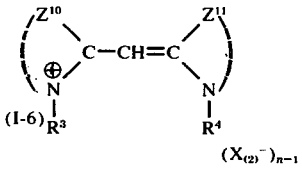

(II-1)

In this formula, $Z^{10}$ and $Z^{11}$ each represents an atomic group necessary for completing a benzothiazole, naphtho[1,2-d]thiazole, benzoselenazole or naphtho[1,2-d]selenazole nucleus. $R^3$, $R^4$, $X_{(2)}^{\ominus}$ and n each has the same meanings as in the general formula (II).

Of the compounds represented by the general formula (II-1), particularly advantageous compounds are represented by the general formula (II-2) or (II-3).

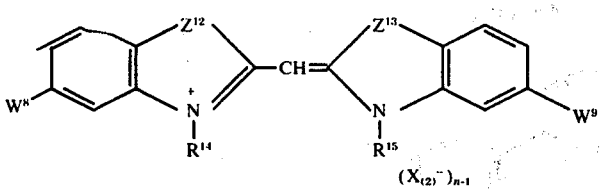

(II-2)

In this formula, $Z^{12}$ and $Z^{13}$ each represents a sulfur atom or a selenium atom, and $W^8$ and $W^9$ each represents a hydrogen atom, a chlorine atom, a bromine atom, a fluorine atom, a methyl group, an ethyl group, a methoxy group or an ethoxy group. $R^{14}$ and $R^{15}$ each represents a methyl group or an ethyl group, or each has the same meanings as $R^8$ and $R^9$ in the general formula (I-3). However, at least one of $R^{14}$ and $R^{15}$ represents a carboxyalkyl group or a sulfoalkyl group. $X_{(2)}^-$ and n each has the same meanings as in the general formula (II-1).

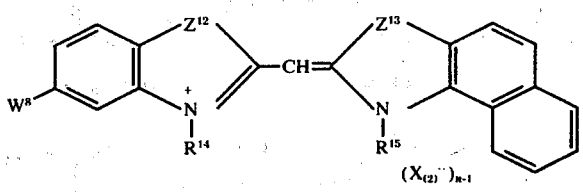

(II-3)

In this formula, $Z^{12}$, $Z^{13}$, $W^8$, $R^{14}$ and $R^{15}$ each has the same meanings as in the general formula (II-2).

Illustrative examples of the sensitizing dyes used in this invention are given below, the invention is not to be construed as being limited to these specific examples. Illustrative examples of the dyes represented by the general formula (I):

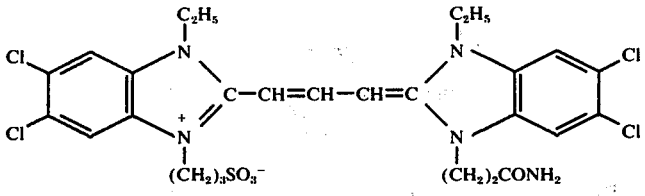

(I-A)

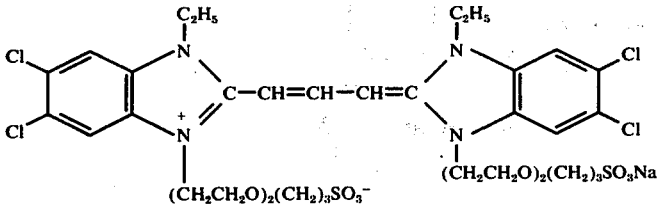

(I-B)

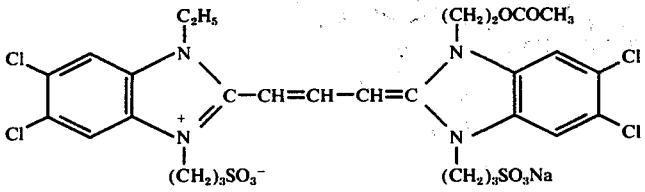

(I-C)

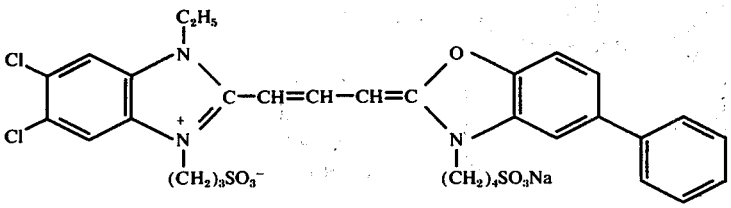

(I-D)

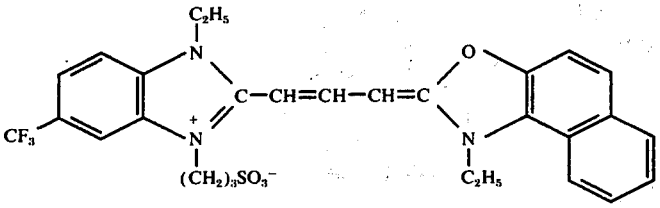

(I-E)

-continued
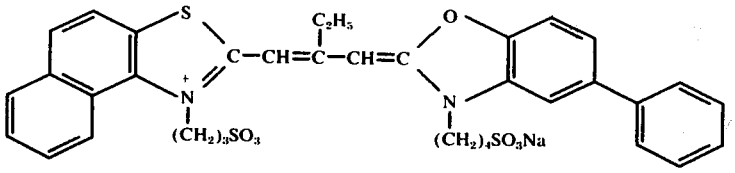
(I-F)
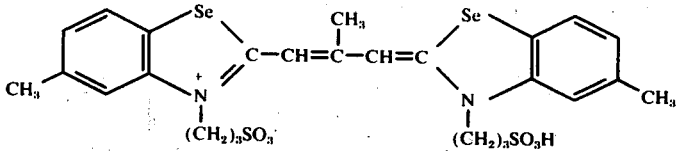
(I-G)
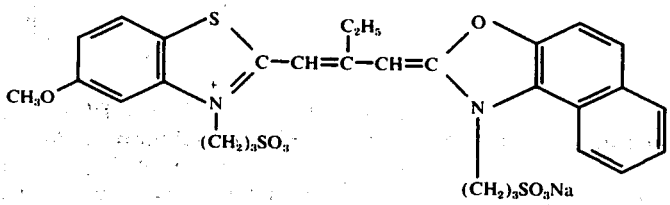
(I-H)
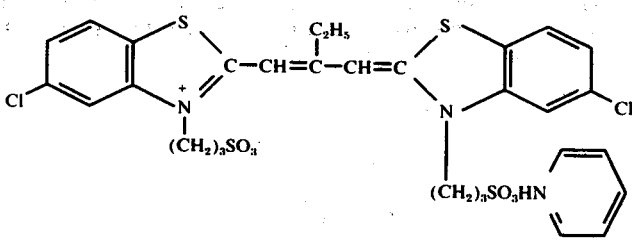
(I-I)
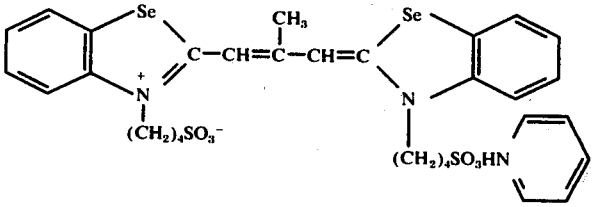
(I-J)
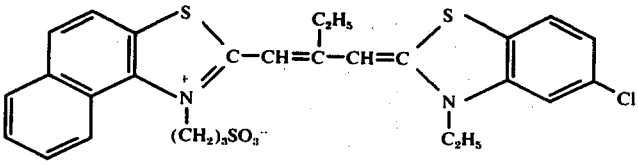
(I-K)
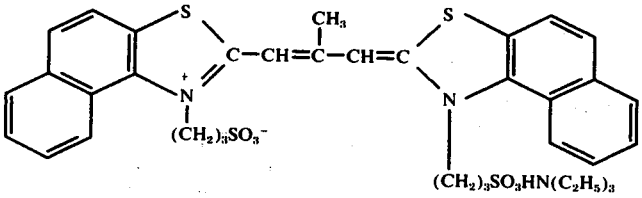
(I-L)
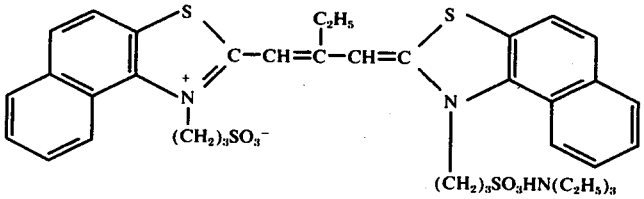
(I-M)

-continued
(I-N)
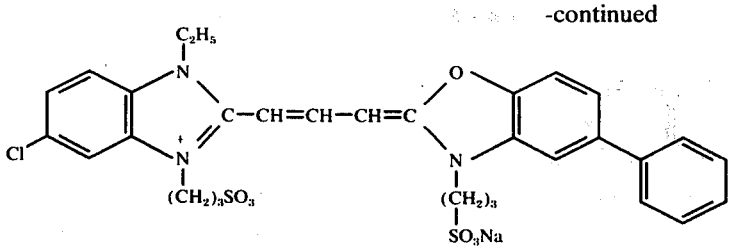
(I-O)
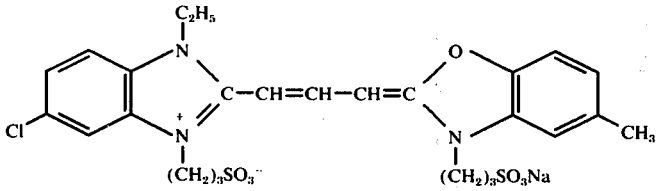
(I-P)
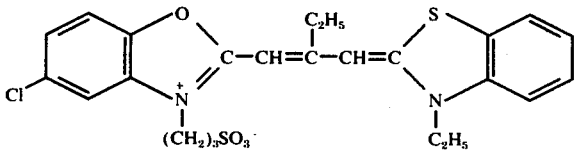
(I-Q)
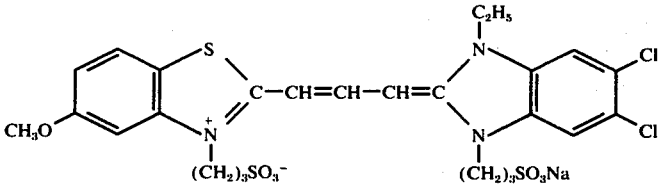
(I-R)
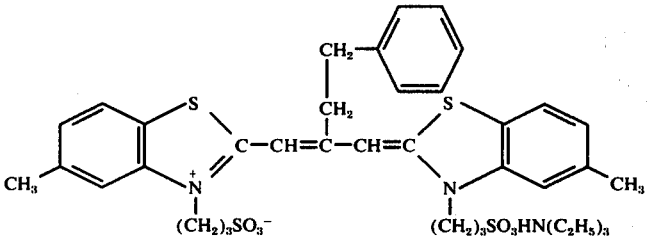
Of the above compounds, dyes (I-I), (I-L), (I-M), (I-N), (I-O) and (I-P) are particularly preferred.
Illustrative examples of dyes represented by the general formula (II) are given below.
(II-A)
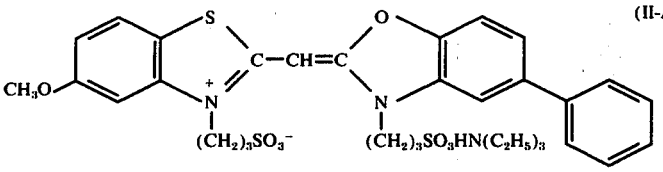
(II-B)
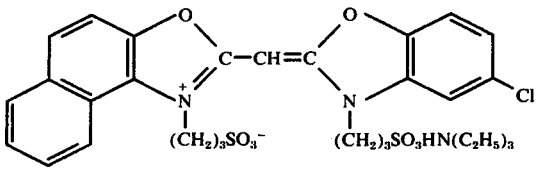
(II-C)
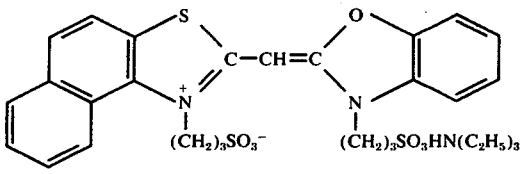

-continued
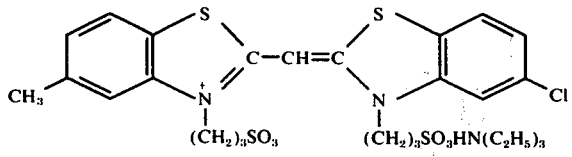
(II-D)
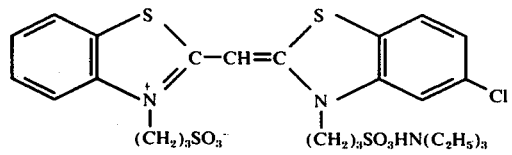
(II-E)
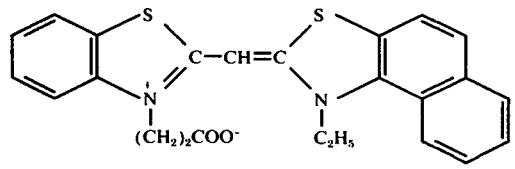
(II-F)
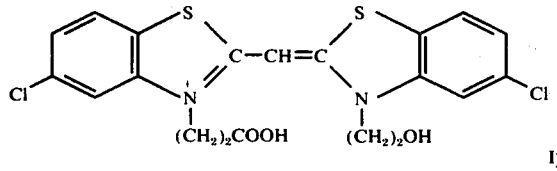
(II-G)
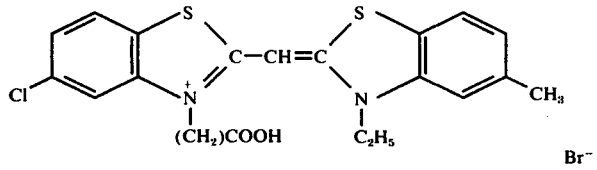
(II-H)
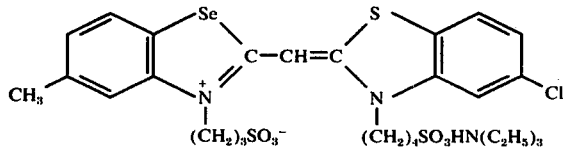
(II-I)
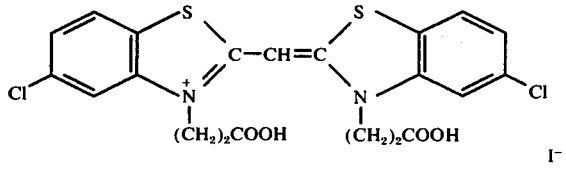
(II-J)
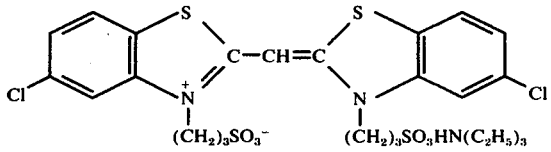
(II-K)
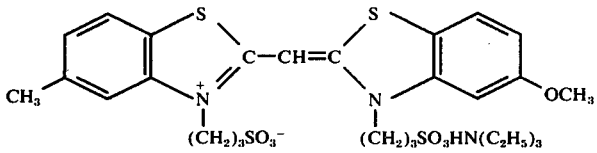
(II-L)

-continued
(II-M)
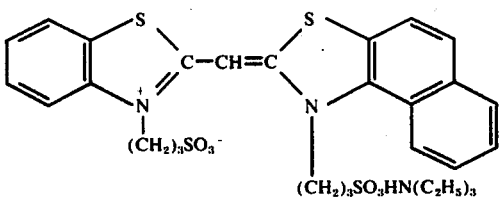
(II-N)
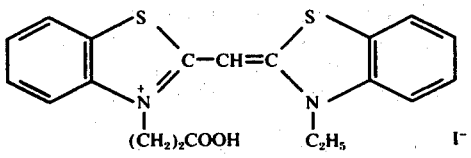
(II-O)
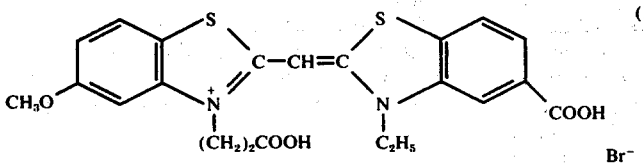
(II-P)
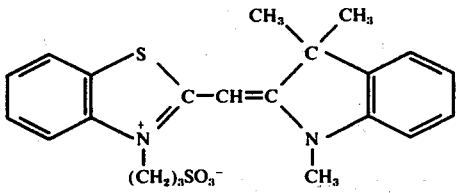
(II-Q)
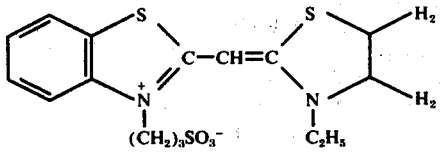
(II-R)
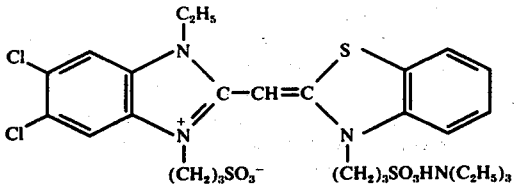
(II-S)
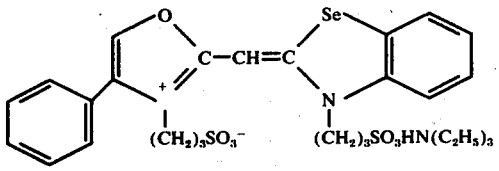
(II-T)
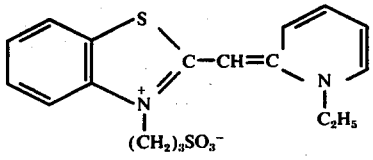
(II-U)
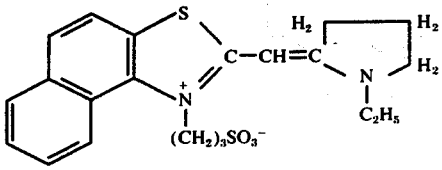

-continued (II-V)

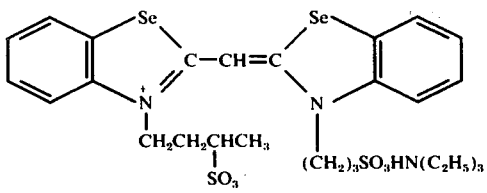

Of the above compounds, particularly preferred dyes are (II-D), (II-J), (II-K), (II-L) and (II-M).

Each of the compounds represented by the general formula (I) and the compounds represented by the general formula (II) is incorporated into a silver halide emulsion in an amount of about $1 \times 10^{-6}$ to $5 \times 10^{-3}$ mol, preferably $1 \times 10^{-5}$ to $2.5 \times 10^{-3}$ mol, particularly $8 \times 10^{-5}$ to $1 \times 10^{-3}$ mol, per mol of silver halide.

The effect due to the combination of the sensitizing dye according to this invention is not reduced when the dyes are used in combination with a known green-sensitive oxacarbocyanine dye or merocyanine dye, that is, the combination of the sensitizing dyes (I) and (II) are further combined with the known dye. However, when a merocyanine dye is used, the merocyanine dye and the combination of the sensitizing dyes of this invention are preferably individually added as separate solutions to the emulsion.

The oxacarbocyanine dyes which can be used together with the sensitizing dyes of this invention are represented, for example, by the following general formula (III).

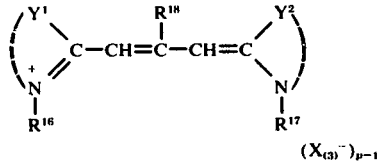

(III)

In this formula, $Y^1$ and $Y^2$ each represents an atomic group necessary for forming a benzoxazole or naphtho[1,2-d]-oxazole nucleus. These nuclei can be substituted with substituents which do not deteriorate the sensitivity, etc., for example, those substituents as described for $Z^1$ and $Z^2$ in the general formula (I). $R^{16}$ and $R^{17}$ each represents an aliphatic group, for example, those as described in the general formulas (I) and (II) for $R^1$, $R^2$, $R^3$ and $R^4$. $R^{18}$ represents a lower alkyl group (such as a methyl or ethyl group), or an aryl group (such as a phenyl group). $X_{(3)}^-$ and p have the same meanings as $X_{(1)}^-$ and m in the general formula (I), respectively.

The merocyanine dyes which can be used, with care as described above, together with the combination of the sensitizing dyes used in this invention are represented, for example, by the following general formula (IV).

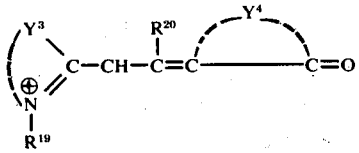

(IV)

In this formula, $Y^3$ represents an atomic group necessary for forming an oxazole, benzoxazole, naphtho[1,2-d]-oxazole, thiazole, benzothiazole, naphtho[1,2-d]thiazole, selenazole, benzoselenazole, naphtho[1,2-d]selenazole, thiazoline or benzimidazole nucleus. These nuclei can be substituted with those substituents as described for $Z^1$ and $Z^2$ in the general formula (I). $Y^4$ represents an atomic group necessary for completing a rhodanine or hydantoin nucleus. $R^{19}$ represents those aliphatic groups as described for $R^1$, $R^2$, $R^3$ and $R^4$ in the general formulas (I) and (II). $R^{20}$ represents a hydrogen atom, a methyl group, an ethyl group, a propyl group, a methoxy group, an ethoxy group, a phenyl group, a benzyl group, a phenethyl group or a carboxyphenyl group.

Illustrative examples of these oxacarbocyanine dyes and merocyanine dyes are set forth below.

(III-A)

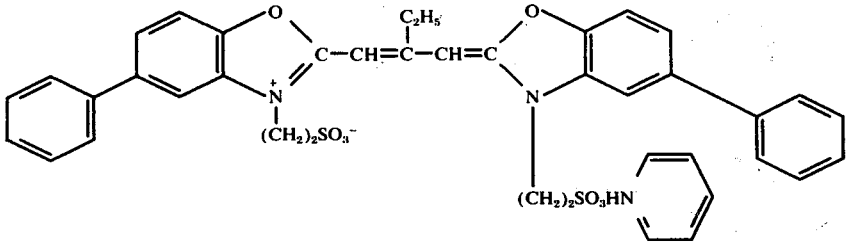

(III-B)

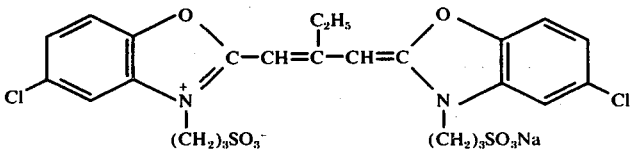

-continued (III-C)

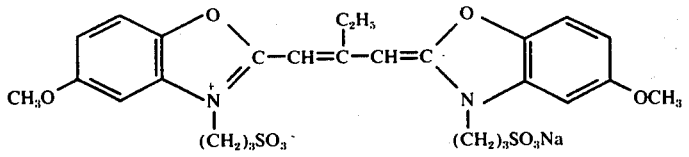

(IV-A)

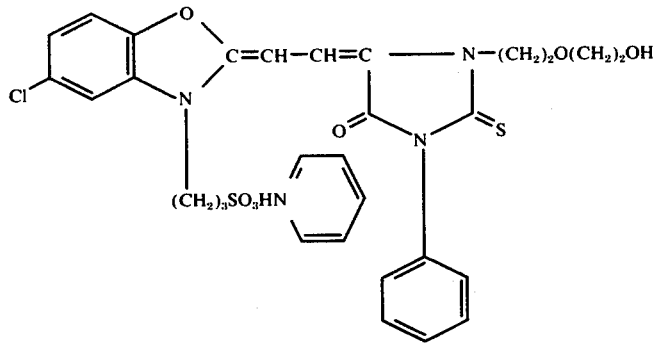

(IV-B)

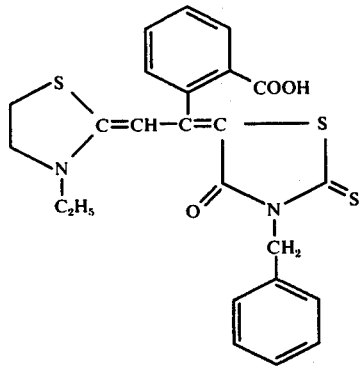

(IV-C)

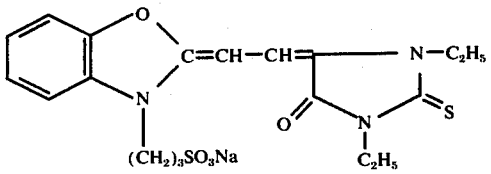

The sensitizing dyes used in this invention can be added to a silver halide emulsion as an aqueous solution or a soluon thereof in a water-miscible organic solvent such as methanol, ethanol, methyl Cellosolve or pyridine.

The sensitizing dyes used in this invention can be dissolved by means of supersonic vibration as described in U.S. Pat. No. 3,485,634. Other methods of dissolving or dispersing the sensitizing dyes of this invention and adding same to a silver halide emulsion can also be used and are described in U.S. Pat. Nos. 3,482,981, 3,585,195, 3,469,987, 3,425,835, and 3,342,605, British Pat. Nos. 1,271,329, 1,038,029 and 1,121,174, and U.S. Pat. Nos. 3,660,101 and 3,658,546. The amounts added of the sensitizing dyes of this invention are usual supersensitizing amounts, for example, about $5 \times 10^{-3}$ to $1 \times 10^{-6}$ mol of each sensitizing dye per mol of silver halide, and the molar ratio of the dye of the general formula (II) to the dye of the general formula (I) is preferably 1:10 to 10:1.

The silver halide photographic emulsion used in this invention can be prepared by conventional methods. The emulsion can contain grains of silver chloride, silver bromide, silver iodide or mixed silver halides precipitated and ripened, for example, by a single jet method or by a double jet method or by using a combined method thereof. Preferred silver halides are silver bromoiodide and silver chlorobromoiodide (preferably containing a halogen composition of less than about 10 mol % iodide), and silver chlorobromide. The silver halide can have either a usual grain size or a fine grain size. The average diameter of the grains (e.g., a number average as measured by the projected area method) is preferably about 0.04 to 1.5 microns. The grain size distribution ("grain size" having the meaning as described above) can be narrow or broad.

The silver halide emulsion can be unripened or subjected to a physical ripening. After the formation of precipitates or after physical ripening, the water-soluble salts are usually removed from the emulsion. For this purpose, a noodle washing method which is well known, or the flocculation method which employs an inorganic salt having a plyvalent anion such as ammonium sulfate, an anionic surface agent, polystyrene sulfonic acid or other anionic polymers, or a gelatin derivative such as an aliphatic or aromatic acylated gelatin can be employed.

A silver halide emulsion which is not chemically sensitized (that is, which is not subjected to after-ripening) can be used, but the silver halide emulsion can be chemically sensitized. Various chemical sensitizing methods such as the methods as described in C.E.K. Mees & T.H. James, *The Theory of the Photographic Process*, 3rd Ed., Macmillan & Co., New York (1966), P. Grafkides, *Chemie Photographique*, Paul Montel, Paris (1957), and H. Frieser, Ed., *Die Grundlagen der Photographischen Prozesse mit Silberhalogeniden*, Akademische Verlagsgesellschaft (1968), or other known methods can be used. For example, sulfur sensitization using a compound containing sulfur capable of reacting with a silver ion, for example, thiosulfate salts, compounds as described in U.S. Pat. Nos. 1,574,944, 2,278,947, 2,410,689, 3,189,458 and 3,501,313, and French Pat. No. 2,059,245, active gelatin, etc.; reduction senstization using a reducing substance such as the stannous salts as described in U.S. Pat. No. 2,487,850, amines as described in U.S. Pat. Nos. 2,518,698, 2,521,925, 2,521,926, 2,419,973 and 2,419,975, iminoaminomethanesulfinic acids as described in U.S. Pat. No. 2,983,610, or silane compounds as described in U.S. Pat. No. 2,694,637, or by the method described in H. W. Wood, *Journal of Photographic Science*, Vol. 1, pages 163 et seq. (1953); gold sensitization using gold complexes as described in U.S. Pat. No. 2,399,083, gold thiosulfate complexes, etc.; sensitization with salts of noble metals such as platinum, palladium, iridium, rhodium or ruthenium as described in U.S. Pat. Nos. 2,448,060, 2,540,086, 2,566,245 and 2,566,263; and the like can be used. These sensitizing methods can be employed individually or as a combination thereof. Moreover, selenium sensitization as described in U.S. Pat. No. 3,297,466 can be used in place of or in combination with sulfur sensitization.

Various compounds can be incorporated in the photographic emulsion for the light-sensitive material of this invention in order to prevent the occurrence of fog during production, during storage of the light-sensitive material or during development processing, or to stabilize the photographic properties. Examples of such compounds are azoles such as benztriazole, benzthiazolium salts as described in U.S. Pat. No. 2,131,038, or aminobenzimidazoles as described in U.S. Pat. No. 2,324,123; nitroazoles such as nitroindazole, nitrobenzotriazole, nitrobenzimidazole as described in British Pat. No. 403,789 or nitroaminobenzimidazoles as described in U.S. Pat. No. 2,324,123; halogen-substituted azoles such as 5-chlorobenzimidazoles, 5-bromoimidazole or 6-chlorobenzimidazole; mercaptoazoles, for example, mercaptothiazole derivatives and mercaptobenzothiazole as described in U.S. Pat. No. 2,824,001, mercaptobemzothiazole derivatives as described in U.S. Pat. No. 2,697,099, mercaptoimidazole derivatives and mercaptobenzimidazoles as described in U.S. Pat. No. 3,252,799, mercaptooxadiazoles as described in U.S. Pat. No. 2,843,491, mercaptothiadiazoles as described in U.S. Pat. No. 1,758,576, or phenylmercaptotetrazoles as described in U.S. Pat. No. 2,403,927; mercaptopyrimidines as described in U.S. Pat. No. 2,304,962; mercaptotriazines as described in U.S. Pat. No. 2,476,536; mercaptotetrazaindenes as described in British Pat. No. 3,226,231; thiosalicylic acids as described in U.S. Pat. No. 2,377,375, thiobenzoic acids as described in British Pat. No. 3,226,231, sugar mercaptals as described in Japanese Pat. Publication No. 8,743/72, and other various mercapto compounds; oxazolinethiones as described in U.S. Pat. No. 3,251,691, and triazolothiadiazoles as described in Japanese Pat. Publication No. 17,932/68. Moreover, nitrogen-containing heterocyclic compounds having an antifogging effect such as urazoles as described in U.S. Pat. No. 2,708,161 or azaindenes compounds, for example, tetrazaindenes (e.g., those as described in U.S. Pat. Nos. 2,444,605, 2,444,606 and 2,450,397, and Japanese Pat. Publication Nos. 10,166/64 and 10,516/67), pentazaindenes (e.g., those as described in U.S. Pat. No. 2,713,541, and Japanese Pat. Publication No. 13,495/68), etc., can be employed. In addition, benzenesulfinic acids and benzenethiosulfonic acids as described in U.S. Pat. No. 2,394,198, benzenesulfinic acid amides as described in Japanese Pat. Publication No. 4,136/68, sugar mercaptals as described in Japanese Pat. Publication No. 8,743/72, and the like can be employed. Various chelating agents as described in U.S. Pat. No. 2,691,588, British Pat. No. 623,488, and Japanese Pat. Publication Nos. 4,941/68 and 13,496/68 can be employed to prevent the occurrence of fog due to metal ions.

The photographic emulsion layer and the other hydrophilic colloid layers in the light-sensitive material of this invention can contain, for the purpose of increasing the sensitivity or contrast, or accelerating development, polyalkylene oxides as described in U.S. Pat. No. 2,441,389, the ethers, esters and amides of polyalkylene oxide as described in U.S. Pat. No. 2,708,161, other polyalkylene oxide derivatives as described in British Pat. No. 1,145,186, Japanese Pat. Publication Nos. 10,989/70, 15,188/70, 43,435/71, 8,106/72 and 8,742/72; thioether compounds as described in U.S. Pat. Nos. 3,046,132, 3,046,133, 3,046,134 and 3,046,135, and Japanese Pat. Publication Nos. 9,019/70 and 11,119/72, thiomorpholines as described in Japanese Pat. Publication No. 28,325/72; quaternary ammonium compounds as described in U.S. Pat. No. 3,772,021, pyrrolidine as described in Japanese Pat. Publication No. 27,037/70; urethane or urea derivatives as described in Japanese Pat. Publication No. 23,465/65; imidazole derivatives as described in Japanese Pat. Publication No. 45,541/72; polymers as described in Japanese Pat. Publication No. 26,471/70, 3-pyrazolidones as described in Japanese Pat. Publication No. 27,670/70; or the like.

The photographic emulsion in the light-sensitive material of this invention can contain an inorganic or organic mercury compound for sensitization or for preventing fog. For example, mercury complexes as described in U.S. Pat. No. 2,728,664; benzthiazole mercury salts as described in U.S. Pat. No. 2,728,667; mercury salt addition compounds as described in U.S. Pat. Nos. 2,728,663 and 2,732,302; and organic mercury compounds as described in U.S. Pat. Nos. 2,728,665 and 3,420,668 can be used.

When the grain diameter of the silver halide (or a value corresponding thereto) is particularly small (below about 0.4 $\mu$m or below about 0.2 $\mu$m), the photographic emulsion in the light-sensitive material of this invention can contain a sensitizer such as the compounds as described in British Pat. Nos. 1,316,493, 1,317,138, 1,317,139, 1,317,709 and 1,297,901, and German Pat. application OLS) No. 2,235,031.

The hardening of the emulsion cn be effected in a conventional manner. Specific examples of the hardeners which can be used include aldehyde compounds such as formaldehyde or glutaraldehyde; ketone compounds such as diacetyl or cyclopentanedione; compounds having reactive halogens such as bis(2-chloroethylurea), 2-hydroxy-4,6-dichloro-1,3,5-triazine or compounds as described in U.S. Pat. Nos. 3,288,775 and 2,732,303, and British Pat. Nos. 974,723 and 1,167,207; compounds having reactive olefins such as divinyl sulfone, 5-acetyl-1,3-diacryloylhexahydro-1,3,5-triazine, or compounds as described in U.S. Pat. Nos. 3,635,718 and 3,232,763, and British Pat. No. 994,869; N-methylol compounds such as N-hydroxymethylphthalimide or compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives as described in U.S. Pat. Nos. 2,725,294 and 2,725,295; carbodiimide compounds as described in U.S. Pat. No. 3,100,704; epoxy compounds as described in U.S. Pat. No. 3,091,537; isooxazole compounds as described in U.S. Pat. Nos. 3,321,313 and 3,543,292; halocarboxyaldehydes such as mucochloric acid; dioxane derivatives such as dihydroxydioxane or dichlorodioxane; and inorganic hardeners such as chrome alum or zirconium sulfate. In place of the above compounds, precursor thereof such as alkali metal bisulfite aldehyde adducts, methylol derivatives of hydantoin or aliphatic primary nitroalcohols can also be used.

Surface active agents can be incorporated individually or in admixture into the photographic emulsion of this invention. The surface active agents are generally used as a coating aid, but they are sometimes employed for other purposes, for example, for improving the emulsion dispersion, the sensitization or the photographic characteristics, for preventing the generation of static charges or adhesion, etc. These surface active agents include natural surface active agents such as saponin; nonionic surface active agents such as alkylene oxides, glycerols, or glycidols; cationic surface active agents such as higher alkylamines, quaternary ammonium salts, pyridinium or other heterocyclic compounds, phosphoniums or sulfoniums; anionic surface active agents containing acid groups such as carboxylic acid, sulfonic acid, phosphoric acid, sulfuric ester group or phosphoric ester groups; and amphoteric surface active agents such as amino acids, aminosulfonic acids, or sulfuric or phosphoric esters of aminoalcohols.

The surface active agents which can be used are described, e.g., in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Pat. application (OLS) No. 1,942,665 and British Pat. Nos. 1,077,317 and 1,198,450, as well as in Ryohei Oda, et al., *Synthesis of Surface Active Agents and Their Applications*, Maki Publisher (1964), A. M. Schwartz, et al., *Surface Active Agents*, Interscience Publications Inc., (1958), and J. P. Sisley, et al., *Encyclopedia of Surface Active Agents*, *Vol.* 2, Chemical Publishing Company (1964).

The silver halide emulsion of this invention, when used for color light-sensitive materials, can contain a color image forming coupler and a dispersing agent therefor. A cyan coupler is particularly preferred as a color image forming coupler. For example, the phenolic couplers as described in U.S. Pat. No. 2,698,794 and the naphtholic couplers as described in U.S. Pat. No. 2,474,293 are particularly useful.

Also, the couplers as described in U.S. Pat. No. 2,600,788, British Pat. No. 904,852, and Japanese Pat. Publication No. 6,031/65, and the $\alpha$-naphtholic cyan couplers and the phenolic cyan couplers as described in U.S. Pat. Nos. 3,311,476, 3,458,315, 3,214,437 and 3,253,924 can be used.

Typical examples of colored couplers are those as described in Japanese Pat. Publication No. 2,016/69, Japanese Pat. application No. 4,597/73, U.S. Pat. Nos. 3,476,560, 3,034,892, 3,386,301, 2,434,272 and 3,476,564, etc.

Typical examples of development inhibitor releasing (DIR) couplers are those as described in U.S. Pat. Nos. 3,148,062, 3,227,554, 3,701,783, 3,617,291 and 3,622,328, Japanese Pat. Publication No. 28,836/70, Japanese Pat. application No. 33,238/73, and German Pat. application (OLS) No. 2,163,811.

The silver halide photographic emulsion used in this invention can contain, as a protective colloid, gelatin and acylated gelatin such as phthalated gelatin or malonated gelatin; cellulose compounds such as hydroxyethyl cellulose or carboxymethyl cellulose; soluble starch such as dextrin; hydrophilic polymers such as polyvinyl alcohol, polyvinyl pyrrolidone, polyacrylamide or polystyrenesulfonic acid; and a plasticizer for dimensional stabilization, a latex polymer and a matting agent. The finished emulsion is coated onto a suitable support.

The support can be any transparent or opaque support generally used for photographic elements, e.g., a glass sheet made of glasses such as soda-lime glass or quartz glass; films of synthetic high molecular weight materials such as polyesters (for example, polyalkylacrylates, polyalkylmethacrylates, polystyrene, polyvinyl chloride, partially formalated polyvinyl alcohol, polycarbonate, polyethylene terephthalate, etc.) or polyamides; films of cellulose derivatives such as cellulose nitrate, cellulose actate or cellulose acetate butyrate; papers, baryta-coated papers, papers coated with an $\alpha$-olefin polymer, synthetic papers of polystyrene or the like, ceramics, metals, etc. A suitable coating amount of the silver halide can range from about $10^{-3}$ to $10^{-1}$ mol/m$^2$ of the support.

This invention is applicable for the sensitization of various silver halide photographic emulsions for color light-sensitive materials and black and white light-sensitive materials. Such emulsions are used in various applications such as color positive films, color papers, color negative films, color reversal films (with or without couplers), photographic light-sensitive materials for lithographic use (such as lith-type light-sensitive materials), light-sensitive materials for recording cathode ray tube displays, light-sensitive materials for X-ray recording (particularly, light-sensitive materials for direct or indicrct photographing using an intensifying fluorescent screen), materials for the colloid transfer process (as described, e.g., in U.S. Pat. No. 2,716,059), materials for the silver salt diffusion transfer process (as described, e.g., in U.S. Pat. Nos. 2,352,014, 2,543,181, 3,020,155 and 2,861,885), materials for the color diffusion transfer process (as described in, e.g., in U.S. Pat. Nos. 3,087,817, 3,185,567, 2,983,606, 3,253,915, 3,227,550, 3,227,551, 3,227,552, 3,415,644, 3,415,645 and 3,415,646), materials for the imbibition transfer process (as described, e.g., in U.S. Pat. No. 2,882,156), materials for the silver-dye-bleach process (as described, e.g., in Friedman, *History of Color Photography*, particularly Chapter 24, American Photographic Publishers Co. (1944), and *British Journal of Photography*, Vol. III, pages 308 – 309 (Apr. 7, 1964)), light-sensitive materials for recording print out images (e.g., as described in U.S. Pat. No. 2,369,449, and Belgian Pat. No. 704,255), light-sensitive materials of the direct print image type (e.g., as described in U.S. Pat. Nos. 3,033,682 and 3,287,137), light-sensitive materials for thermal development (e.g., as described in U.S. Pat. Nos. 3,152,904 and 3,312,550, and British Pat. No. 1,110,046), light-sensitive materials for physical development (e.g., as described in British Pat. Nos. 920,277 and 1,131,238), and the like.

The supersensitization technique according to this invention is particularly useful for the preparation of lith-type light-sensitive materials for photoengraving, incorporated-coupler type color light-sensitive materials having a multilayer structure, particularly, color light-sensitive materials for color reversal or color negative films, high speed light-sensitive materials for black and white negative films, light-sensitive materials for microphotographic negartive films, and light-sensitive materials for X-ray photography.

"Lith-type" light-sensitive materials refer to the light-sensitive materials which generally contain dihydroxybenzenes as a developing agent and can provide the reproduction of very high contrast through infectious development processing in the presence of a low sulfite ion concentraton for the purpose of the photographic reproduction of line images or the photographic reproduction of half tone images formed by dots (e.g., as described in Mason, *Photographic Processing Chemistry*, pages 163 – 165 (1966)).

In addition, the dyes used in this invention can be employed for spectral sensitization using the method as described in German Pat. application (OLS) No. 2,104,283 or the method as described in U.S. Pat. No. 3,649,286.

The following non-limiting examples are given in order to further explain this invention. Unless otherwise indicated herein, all parts, percents, ratios and the like are by weight.

The structures of the dyes used for comparison in the Examples given hereinafter are shown below.

(B)

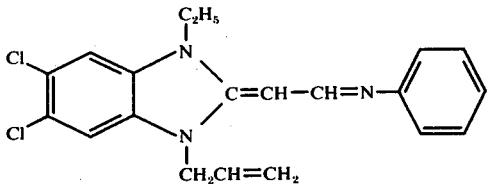

(C)

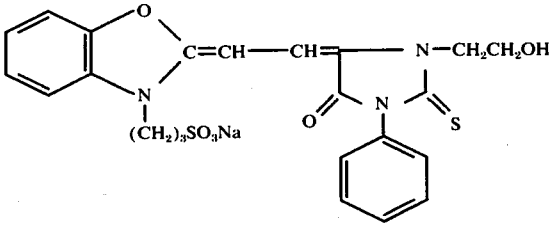

-continued (D)

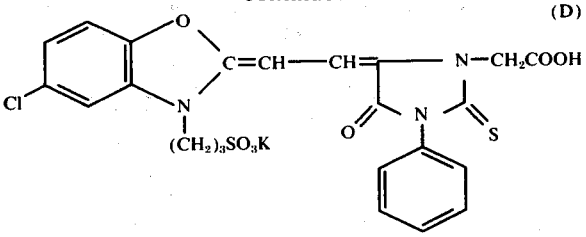

(E)

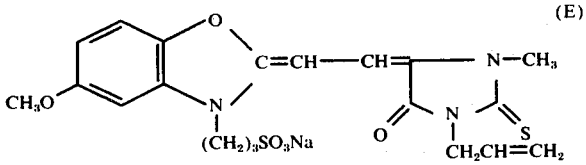

(F)

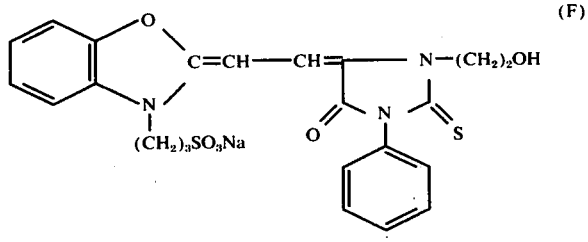

(G)

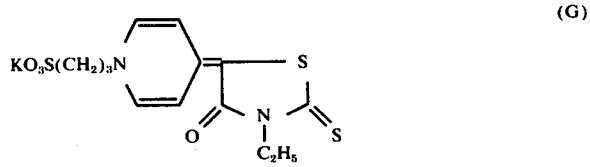

EXAMPLE 1

A silver chlorobromoiodide emulsion having an iodide content of 0.25 mol %, a bromide content of 16.5 mol % and the remainder chloride was prepared by precipitating silver halide grains using the double jet method and subjecting the same to physical ripening, desalting and chemical ripening. The average diameter of the silver halide grais contained in this emulsion was 0.4 microns. This emulsion contained 1.18 mols of silver halide per kg of the emulsion. This emulsion (1 kg) was melted in a constant temperature bath at 50° C. Methanol solutions of the sensitizing dyes of this invention and the comparative sensitizing dyes shown below were added in the respective predetermined amounts to the emulsion, which were mixed with stirring at 40° C. 20 cc of a 1% by weight aqueous solution of 4-hydroxy-6-methyl-1,3,3a,7-tetrazaindene, 10 cc of a 1% by weight aqueous solution of sodium 2-hydroxy-4,6-dichlorotriazine and 10 cc of a 1% by weight aqueous solution of sodium dodecylbenzenesulfonate were successively added followed by stirring. The finished emulsion was coated on a cellulose triacetate film support so as to provide a film thickness of 5 microns on a dry basis and dried, thus obtaining a sample of a light-sensitive material. The sample was cut into strips. One of each of the strips was subjected to an optical wedge exposure using a sensitometer with a light source of a color temperature of 5400° K through a blue filter (Wratten filter No. 47 B), a green filter (Wratten filter No. 58) and a red filter (Wraten filter No. 25), each made by Eastman Kodak Company, which filters were respectively attached to the light source. Each of the other of the strips was exposed to obtain a spectrogram using a diffraction grating type spectrograph with a tungsten light source of a color temperature of 2666° K.

Each of the samples was developed at 20° C for 2 minutes using a developer having the following composition, stopped, fixed and washed with water to obtain a strip having a predetermined black and white image.

| Composition of Developer | |
|---|---|
| Water | 500 ml |
| Metol | 2 g |
| Sodium Sulfite (anhydrous) | 40 g |
| Hydroquinone | 4 g |
| Sodium Carbonate (monohydrate) | 28 g |

-continued

| Composition of Developer | |
|---|---|
| Potassium Bromide | 1 g |
| Water to make | 1 l |

At the time of using, an equal volume of water was added to the developer.

The strip was then subjected to density measurement using an S-type densitometer made by Fuji Photo Film Co., Ltd., to obtain a blue filter sensitivity (SB), a green filter sensitivity (SG), a red filter sensitivity (SR) and fog. The standard point of the optical density to determine the sensitivity was set at fog + 0.20.

The results obtained are shown in Table 1 to Table 3 as relative sensitivities.

TABLE 1

Figure 2:
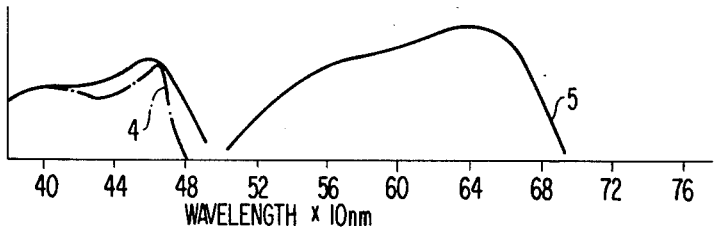
Figure 3:
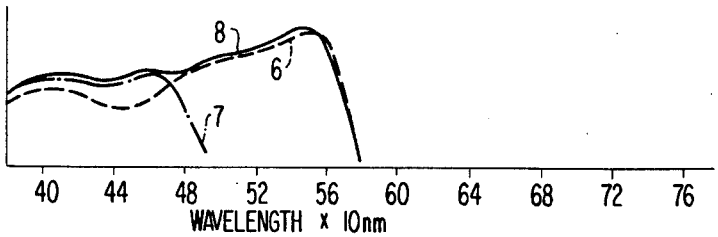
Figure 6:
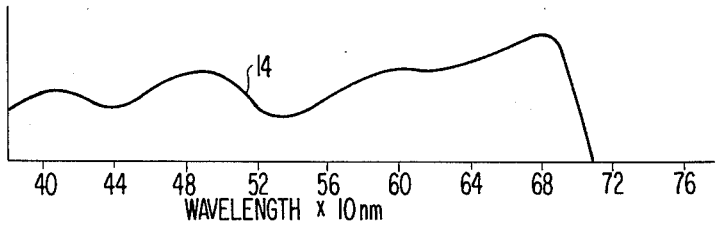

| Run No. | Sensitizing Dye and Amount Added ($\times 10^{-5}$ mol) | | | | SR (relative value) | SB (relative value) | Fog | Spectrogram |
|---|---|---|---|---|---|---|---|---|
| 1 | | — | | — | — | 100 | 0.05 | |
| | (I-M) | 3 | | | 48 | 100 | 0.05 | |
| | | 6 | | | 100 | 100 | 0.05 | Curve 1 in FIG. 1 |
| | | | (II-D) | 8 | — | 153 | 0.05 | |
| | | | | 16 | — | 170 | 0.05 | Curve 2 in FIG. 1 |
| | (I-M) | 6 | (II-D) | 8 | 162 | 153 | 0.05 | |
| | | 6 | | 16 | 169 | 195 | 0.06 | Curve 3 in FIG. 3 |
| 2 | | | (II-E) | 8 | — | 130 | 0.05 | |
| | | | | 16 | — | 143 | 0.05 | |
| | (I-M) | 6 | (II-E) | 8 | 162 | 130 | 0.05 | |
| | | 6 | | 16 | 169 | 176 | 0.05 | |
| 3 | (I-L) | 4 | | | 118 | 94 | 0.05 | |
| | | 8 | | | 137 | 94 | 0.05 | |
| | (I-L) | 8 | (II-D) | 8 | 167 | 158 | 0.05 | |
| | | 8 | | 16 | 208 | 182 | 0.06 | |
| 4 | (I-G) | 8 | | | 70 | 94 | 0.05 | |
| | | | (II-M) | 8 | — | 154 | 0.05 | |
| | | | | 16 | — | 154 | 0.05 | |
| | (I-G) | 8 | (II-M) | 8 | 112 | 154 | 0.05 | |
| | | 8 | | 16 | 123 | 154 | 0.05 | |
| 5 | | | (II-H) | 8 | — | 145 | 0.05 | |
| | | | | 16 | — | 161 | 0.05 | Curve 4 in FIG. 2 |
| | (I-M) | 8 | (II-H) | 8 | 166 | 145 | 0.05 | |
| | | 8 | | 16 | 166 | 166 | 0.05 | Curve 5 in FIG. 2 |
| 6 | | — | (II-C) | 8 | — | 127 | 0.05 | |
| | | — | | 16 | — | 140 | 0.05 | |
| | (I-M) | 8 | | — | 123 | 90 | 0.06 | |
| | (I-M) | 8 | (II-C) | 8 | 160 | 127 | 0.06 | |
| | | 8 | | 16 | 167 | 145 | 0.06 | |
| 7 | | — | (E)* | 8 | — | 115 | 0.05 | |
| | | — | | 16 | — | 123 | 0.05 | |
| | (I-M) | 6 | (E) | 8 | 100 | 115 | 0.05 | |
| | | 6 | | 16 | 100 | 127 | 0.05 | |
| 8 | | — | (F)* | 8 | — | 115 | 0.05 | |
| | | — | | 16 | — | 127 | 0.05 | |
| | (I-M) | 6 | (F) | 8 | 110 | 120 | 0.05 | |
| | | 6 | | 16 | 105 | 127 | 0.06 | |
| 9 | | | (G)* | 10 | — | 142 | 0.05 | |
| | (I-M) | 3 | (G) | 10 | 45 | 132 | 0.05 | |
| | | 6 | | 10 | 96 | 125 | 0.05 | Curve 14 in FIG. 6 |

*Comparative dye

TABLE 2

| Run No. | Sensitizing Dye and Amount Added ($\times 10^{-5}$ mol) | | | | SR (relative value) | SB (relative value) | Fog | Spectrogram |
|---|---|---|---|---|---|---|---|---|
| 1 | | — | | — | — | 100 | 0.05 | |
| | (I-P) | 8 | | | 96 | 100 | 0.05 | |
| | | 16 | | | 100 | 103 | 0.05 | |
| | | | (II-E) | 10 | — | 135 | 0.05 | |
| | (I-P) | 8 | (II-E) | 10 | 122 | 140 | 0.05 | |
| | 16 | | 10 | 126 | 140 | 0.05 | | |
| 2 | | | (II-F) | 8 | — | 166 | 0.05 | |
| | | | | 16 | — | 204 | 0.05 | |
| | (I-H) | 16 | | | 78 | 131 | 0.05 | |
| | (I-H) | 16 | (II-F) | 8 | 104 | 189 | 0.05 | |
| | | 16 | | 16 | 116 | 224 | 0.05 | |
| 3 | (I-D) | 8 | | | 135 | 126 | 0.05 | Curve 6 in FIG. 3 |
| | | | (II-L) | 8 | — | 154 | 0.05 | |
| | | | | 16 | — | 183 | 0.05 | Curve 7 in FIG. 3 |
| | (I-D) | 8 | (II-L) | 8 | 149 | 177 | 0.05 | |
| | | 8 | | 16 | 161 | 233 | 0.05 | Curve 8 in FIG. 3 |

TABLE 2-continued

Figure 4:
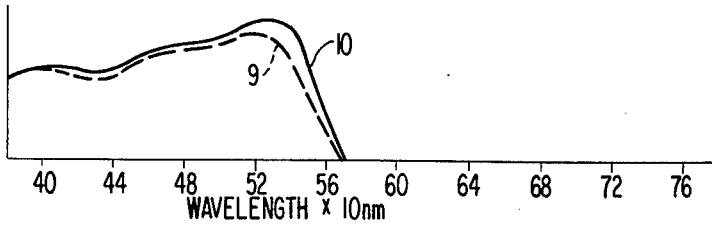
Figure 5:
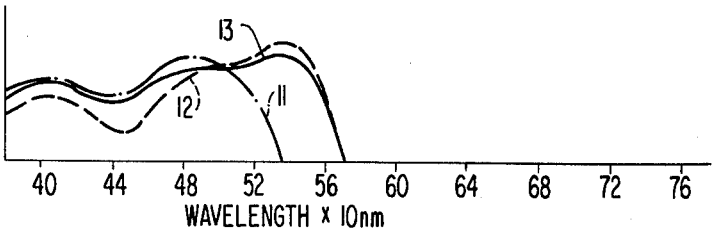

| Run No. | Sensitizing Dye and Amount Added (× $10^{-5}$ mol) | | | | SR (relative value) | SB (relative value) | Fog | Spectrogram |
|---|---|---|---|---|---|---|---|---|
| 4 | (I-O) | 8 | | | 52 | 141 | 0.05 | |
| | | 16 | | | 97 | 180 | 0.05 | Curve 9 in FIG. 4 |
| | (I-O) | 16 | (II-D) | 8 | 161 | 210 | 0.05 | |
| | | 16 | | 16 | 167 | 218 | 0.05 | Curve 10 in FIG. 4 |
| 5 | (I-N) | 8 | | | 43 | 136 | 0.05 | |
| | | 16 | | | 108 | 168 | 0.05 | |
| | (I-N) | 16 | (II-D) | 8 | 124 | 167 | 0.05 | |
| | | 16 | | 16 | 130 | 188 | 0.05 | |
| 6 | (D)* | 8 | | | 60 | 118 | 0.05 | |
| | | 16 | | | 67 | 118 | 0.05 | Curve 12 in FIG. 5 |
| | | | (G)* | 8 | — | 120 | 0.05 | |
| | | | | 16 | — | 176 | 0.05 | Curve 11 in FIG. 5 |
| | (D) | 16 | (G) | 8 | 67 | 120 | 0.05 | |
| | | 16 | | 16 | 58 | 170 | 0.05 | Curve 13 in FIG. 5 |

*Comparative dye

TABLE 3

Figure 7:
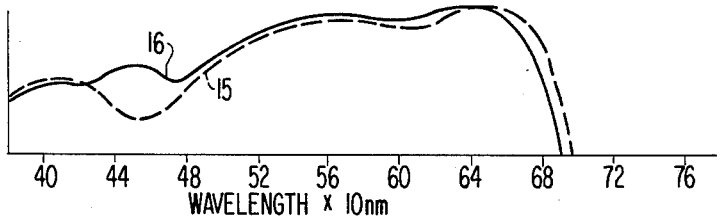
Figure 8:
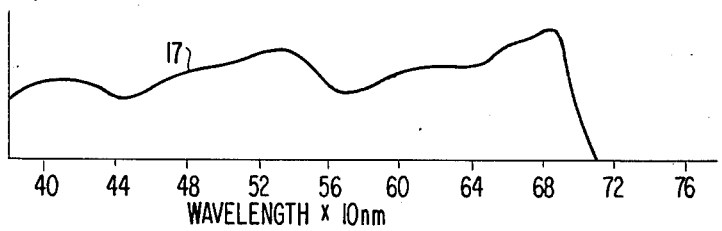

| Run No. | Sensitizing Dye and Amount Added (× $10^{-5}$ mol) | | | | | | | SR (relative value) | SG (relative value) | SB (relative value | Fog | Spectrogram |
|---|---|---|---|---|---|---|---|---|---|---|---|---|
| 1 | (I-L) | 12 | | — | | — | — | 100 | 100 | 92 | 0.05 | |
| | (I-L) | 12 | (I-P) | 16 | | — | — | 119 | 186 | 107 | 0.05 | |
| | | — | | — | (II-L) | 8 | — | — | — | 154 | 0.05 | |
| | (I-L) | 12 | (I-P) | 16 | (II-L) | 8 | — | 124 | 186 | 157 | 0.05 | |
| | (I-L) | 12 | (I-P) | 16 | (II-L) | 8 | (III-A) 4 | 124 | 226 | 162 | 0.06 | |
| | | 12 | | 16 | | 8 | 8 | 128 | 229 | 157 | 0.07 | |
| | (I-L) | 12 | (I-P) | 16 | (II-L) | 8 | (III-B) 8 | 124 | 232 | 162 | 0.05 | |
| | | 12 | | 16 | | 8 | 16 | 132 | 232 | 162 | 0.05 | |
| | (I-L) | 12 | (I-P) | 16 | (II-L) | 8 | (IV-A) 16 | 128 | 206 | 157 | 0.05 | |
| | | — | | — | | — | — | — | — | 100 | 0.05 | |
| 2 | (I-M) | 6 | (I-P) | 16 | | — | — | 110 | 185 | 100 | 0.05 | Curve 15 in FIG. 7 |
| | (I-M) | 6 | (I-P) | 16 | (II-D) | 8 | — | 115 | 214 | 157 | 0.05 | |
| | | 6 | | 16 | | 16 | — | 115 | 229 | 177 | 0.05 | Curve 16 in FIG. 7 |
| | (I-M) | 6 | (I-P) | 16 | (II-D) | 8 | (IV-C) 16 | 125 | 239 | 189 | 0.05 | |
| | | 6 | | 16 | | 8 | 32 | 125 | 239 | 189 | 0.05 | |
| | | | | | (II-D) | 8 | | — | — | 153 | 0.05 | |
| | | | | | | 16 | | — | — | 170 | 0.05 | |
| 3 | (I-M) | 6 | (D)* | 8 | | | | 104 | 126 | 110 | 0.05 | |
| | | 6 | | 16 | | | | 104 | 150 | 126 | 0.05 | |
| | (I-M) | 6 | (D) | 16 | (G)* | 16 | | 100 | 140 | 140 | 0.05 | Curve 17 in FIG. 8 |
| | | 6 | | 16 | | 32 | | 96 | 136 | 140 | 0.05 | |

*Comparative dye

EXAMPLE 2

The combination of the sensitizing dyes of this invention and the combination of the sensitizing dyes for comparison shown were respectively dissolved in methanol and then kept at 20° C for 1 hour, 24 hours or 6 days. Thereafter, the solutions were respectively added to a silver chlorobromoiodide emulsion as described in Example 1, and other additives were added thereto in the same manner as in Example 1. The emulsion thus-obtained was coated, dried, exposed, developed and then evaluated as to sensitivity.

The results obtained are shown in Table 4 as relative values.

In Table 4, the values of SR* and SG* means relative sensitivities when the value obtained using each solution kept for 1 hour is assumed to be 100 in Runs No. 1 and No. 2.

TABLE 4

Figure 9:
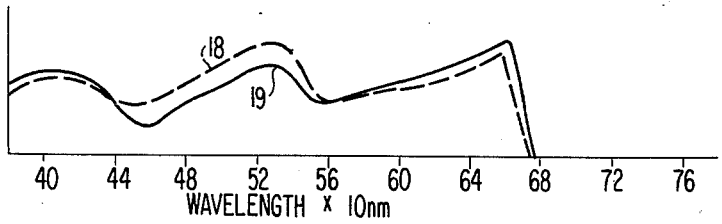

| Run No. | Solution Holding Time | Sensitizing Dye and Amount Added (×$10^{-5}$ mol) | | | | SR* (relative value) | SG* (relative value) | SB (relative value) | Fog | spectrogram |
|---|---|---|---|---|---|---|---|---|---|---|
| 1 | | | — | | — | — | — | 100 | 0.05 | |
| | 1 Hour | (I-I) | 16 | (C) | 16 | 100 | 100 | 100 | 0.05 | Curve 18 in FIG. 9 |
| | 24 Hours | (I-I) | 16 | (C) | 16 | 114 | 86 | 106 | 0.15 | |
| | 6 Days | (I-I) | 16 | (C) | 16 | 132 | 56 | 118 | 0.41 | Curve 19 in FIG. 9 |
| 2 | 1 Hour | (I-I) | 16 | (II-A) | 16 | 100 | 100 | 149 | 0.05 | |
| | 24 Hours | (I-I) | 16 | (II-A) | 16 | 100 | 100 | 149 | 0.05 | |
| | 6 Days | (I-I) | 16 | (II-A) | 16 | 96 | 98 | 142 | 0.06 | |

Run No. 1 in Table 4 above employs a mixed solution of thiacarbocyanine and dimethinemerocyanine, and Run No. 2 employs a mixed solution of the sensitizing dyes of this invention.

As is apparent from the results in Table 4 above, Run No. 1 showed that when the dye solution kept for 24 hours was used, the fog was increased to three times that obtained with the dye solution kept for 1 hour, and the green sensitivity SG was reduced with an increase in the red sensitivity. In using the dye solution kept for 6 days in Run No. 1, the fog was further increased, and the green sensitivity was markedly reduced. On the other hand, only a slight reduction of sensitivity occurred with sensitizing dyes of this invention even when the dye solution kept for 6 days was used.

EXAMPLE 3

A silver bromoiodide emulsion having an iodide content of 7 mol % was prepared by precipitating silver halide grains by a double jet method and subjecting the same to physical ripening, desalting and chemical ripening.

The average diameter of the silver halide grains contained in the emulsion was 0.7 microns. This emulsion contained 0.52 mols of silver halide per kg of the emulsion.

This emulsion (1 kg) was melted in a constant temperature bath at 50° C. Methanol solutions of the sensitizing dyes of this invention and comparative sensitizing dyes were added in respective predetermined amounts to the emulsion, which was mixed with stirring at 40° C. 10 cc of 1% by weight aqueous solution of 4-hydroxy-6-methyl-1,3,3a,7-tetrazaindene, 10 cc of 1% by weight aqueous solution of 1-hydroxy-3,5-dichlorotriazine sodium salt and 10 cc of 1% by weight aqueous solution of sodium dodecylbenzenesulfonate were successively added followed by stirring. The finished emulsion was coated on a cellulose triacetate film support in a film thickness of 5 $\mu$ on a dry basis and dried, thus obtaining a sample of a light-sensitive material. Each of the film samples was cut into strips. One of the strips was subjected to optical wedge exposure using the same sensitometer as in Example 1 through a red filter (Wratten No. 25) and a blue filter (Wratten No. 47 B) and a yellow filter (SC-50), which filters were respectively attached to the light source. The other of the strips was exposed using the same diffraction grating type spectrograph as in Example 1 to obtain a spectrogram.

The sample was developed at 20° C for 7 minutes using a developer having the following composition, stopped, fixed and washed with water to obtain a strip having a predetermined black and white image.

| Composition of Developer | |
|---|---|
| Water | 700 cc |
| Metol | 2 g |
| Sodium Sulfite (anhydrous) | 100 g |
| Hydroquinone | 5 g |
| Borax (pentahydrate) | 1.5 g |
| Water to make | 1 l |

The strip was then subjected to density measurement using an S-type densitometer made by Fuji Photo Film Co., Ltd. to obtain a blue filter sensitivity (SB), a yellow filter sensitivity (SY), a red filter sensitivity (SR) and fog. The standard point of the optical density to determine the sensitivity was set at a point of fog + 0.2.

The results obtained are shown in Table 5 and Table 6 as relative sensitivities.

TABLE 5

| Run No. | Sensitizing Dye and Amount Added ($\times 10^{-5}$ mol) | | | | SY (Relative value) | SB (Relative value) | (Relative Fog |
|---|---|---|---|---|---|---|---|
| 1 | | — | | — | — | 100 | 0.04 |
| | (I-A) | 2 | | | 100 | 87 | 0.04 |
| | | 4 | | | 120 | 81 | 0.04 |
| | | | (II-N) | 4 | — | 100 | 0.04 |
| | | | | 8 | — | 94 | 0.04 |
| | (I-A) | 4 | (II-N) | 4 | 148 | 81 | 0.04 |
| | | 4 | | 8 | 148 | 81 | 0.04 |
| 2 | | | (II-F) | 4 | — | 87 | 0.04 |
| | | | | 8 | — | 87 | 0.04 |
| | (I-A) | 4 | (II-F) | 4 | 176 | 84 | 0.04 |
| | | 4 | | 8 | 176 | 81 | 0.04 |
| 3 | (I-B) | 2 | | | 104 | 90 | 0.04 |
| | | 4 | | | 120 | 84 | 0.04 |
| | (I-B) | 4 | (II-F) | 4 | 176 | 84 | 0.04 |
| | | 4 | | 8 | 171 | 84 | 0.04 |
| 4 | (I-Q) | 4 | | | 116 | 94 | 0.04 |
| | | 8 | | | 161 | 94 | 0.05 |
| | | | (II-O) | 4 | — | 97 | 0.04 |
| | | | | 8 | — | 97 | 0.04 |
| | ( I-Q) | 8 | (II-0) | 4 | 214 | 94 | 0.05 |
| | | 8 | | 8 | 214 | 87 | 0.05 |
| 5 | (I-D) | 4 | | | 100 | 97 | 0.04 |
| | | 8 | | | 137 | 94 | 0.05 |
| | (I-D) | 8 | (II-F) | 4 | 154 | 87 | 0.05 |
| | | 8 | | 8 | 160 | 87 | 0.05 |

TABLE 6

Figure 10:
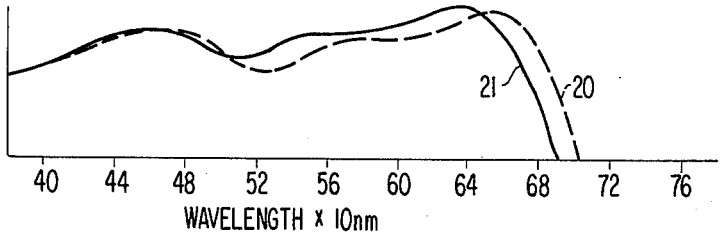
Figure 11:
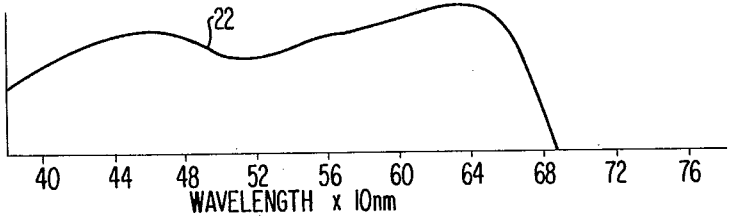
Figure 12:
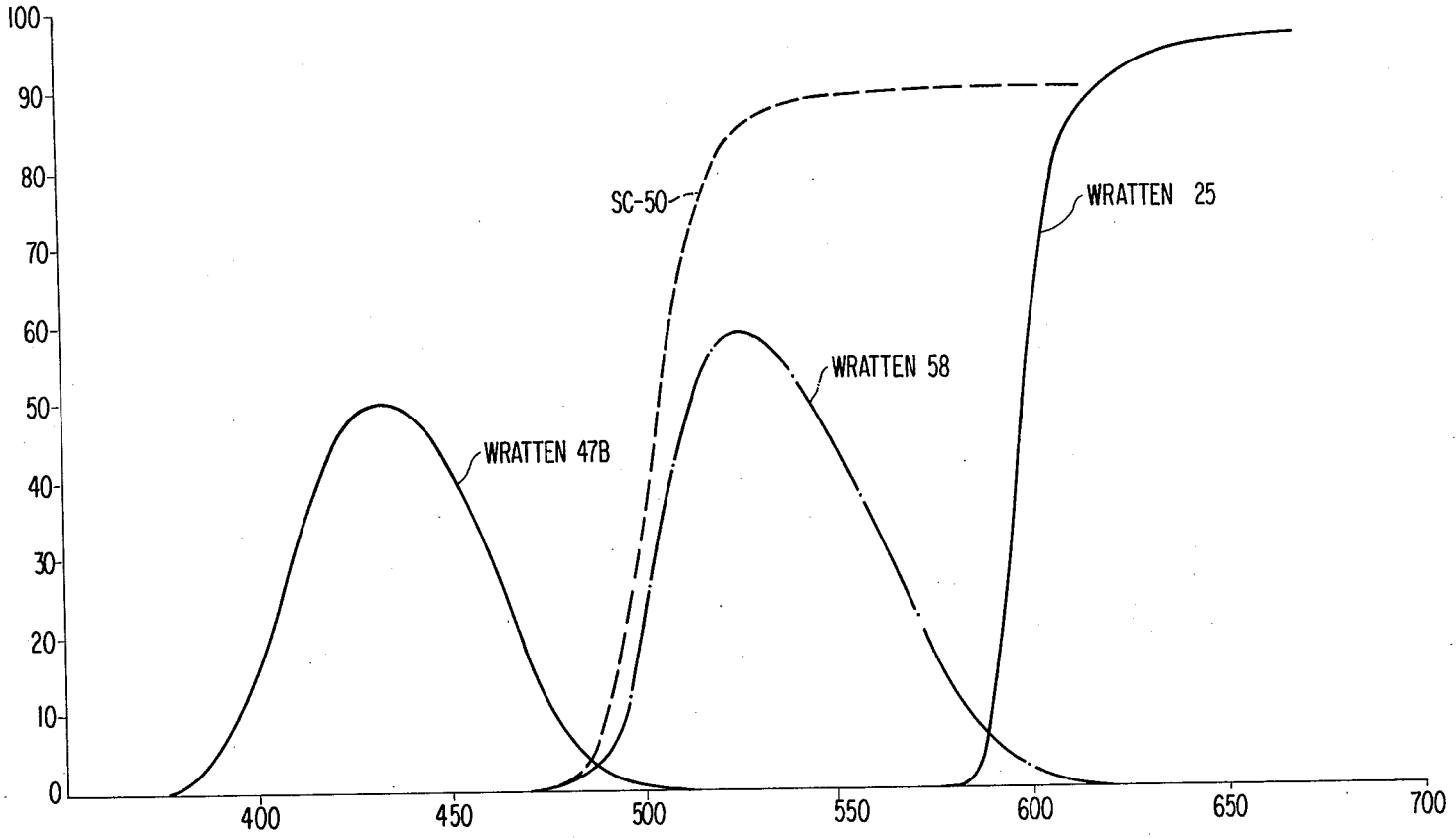
FIG. 12 shows the spectral transmission curves of the filters used in Examples, i.e., Wratten Filter No. 25, Wratten Filter No. 58 and Wratten Filter No. 47 B (made by Eastman Kodak Company) and Fuji Filter SC-50 (made by Fuji Photo Film Co., Ltd.).

| Run No. | Sensitizing Dye and Amount Added ($\times 10^{-5}$ mol) | | | | | | | SR (relative value) | SY (relative value) | SB (relative value) | Fog | Spectrogram |
|---|---|---|---|---|---|---|---|---|---|---|---|---|
| 1 | | — | | — | | — | — | — | — | 100 | 0.04 | |
| | (I-M) | 1 | (I-I) | 8 | | — | — | 100 | 100 | 87 | 0.05 | Curve 20 in FIG. 10 |
| | (I-M) 1 | (I-I) | 8 | (II-O) | 4 | — | 110 | 116 | 87 | 0.05 | Curve 21 in FIG. 10 | |
| | | 1 | | 8 | | 8 | — | 105 | 116 | 87 | 0.05 | |
| 2 | (I-M) | 1 | (I-I) | 8 | (B)* | 4 | — | 93 | 110 | 71 | 0.05 | Curve 22 in FIG. 11 |
| | | 1 | | 8 | | 8 | — | 81 | 114 | 71 | 0.05 | |
| 3 | (I-M) | 1 | (I-I) | 8 | (II-O) | 4 | (III-C) | 4 | 114 | 142 | 90 | 0.05 |
| | | 1 | | 8 | | 4 | | 8 | 110 | 147 | 87 | 0.05 |

*Comparative dye

Some of the advantages obtained by this invention are set forth below.

By using the emulsion of this invention, in panchromatic light-sensitive materials, particularly lith-type light-sensitive materials, a marked increase in red sensitivity with a marked increase in blue sensitivity can be obtained.

In panchromatic light-sensitive materials, particularly lith-type light-sensitive materials, a well known useful method is to use, in combination, a carbocyanine dye (particularly a thiacarbocyanine or 4,5-benzothiacarbocyanine dye) and a dimethinemerocyanine dye (such as a merocyanine dye having a thiahydantoin nucleus). Moreover, in order to further increase the blue sensitivity, it is also known to use a simple merocyanine together with the above combination. Dye (I-M) used in Example 1 is well known as a typical red-sensitizing dye, and a combination thereof with a merocyanine dye is described in German Pat. application (OLS) No. 2,239,711 . However, such combination does not appreciably increase the red sensitivity over that obtained with the use of the carbocyanine dye alone. On the contrary, according to this invention, the red sensitivity is markedly increased over that obtained with the use of the carbocyanine alone simultaneously with a marked increase in the blue sensitivity. This is evident on comparing Run No. 7 with Run No. 8, and Run No. 1 with Run No. 6 in Table 1 showing the results of Example 1. The dye combinations used in Run No. 7 and Run No. 8 are found in the German Pat. application (OLS) No. 2,239,711 . Moreover, it is apparent from Run. No. 9 in Table 1 and Run No. 3 in Table 3 that the simple merocyanine dye used in order to increase the blue sensitivity influences the red-sensitizing effect of the carbocyanine dye. That is, the red-sensitizing effect of the carbocyanine dye is reduced when it is combined with the simple merocyanine dye. However, such an influence is not observed in this invention.

In addition, this invention provides an emulsion superior in red sensitivity, green sensitivity and blue sensitivity to those obtained by known methods. That is, the dye combinations used in Run. No. 3 in Table 3, (I-M) + (D) and (I-M) + (D) + (G) are described in German Pat. application (OLS) Nos. 2,239,711 or 2,101,071, and the dye combinations used in Run No. 1 and Run No. 2 in Table 3 are based on this invention. On comparing them, it is apparent that the emulsions of this invention exceed the sensitivity obtained by known methods in all of the red, green and blue sensitivities. This effect of this invention is a surprising advance considering that there is a great difficulty in increasing sensitivity even in one wavelength region (for example, the red wavelength region).

In orthochromatic light-sensitive materials, particularly lith-type light-sensitive materials, this invention increases the blue sensitivity and also provides a marked supersensitizing effect in the green wavelength region. In orthochromatic light-sensitive materials, particularly lith-type light-sensitive materials, it was considered so far to be useful to use a dimethinecyanine dye having a thiohydantoin nucleus or another nucleus individually or in combination with a simple merocyanine dye, as described in German Pat. application (OLS) No. 2,101,071. However, such dye combinations do not increase the green sensitivity, although they can do increase the blue sensitivity. On the contrary, this invention increases the blue sensitivity and also markedly increases the green sensitivity due to a supersensitizing effect. This is apparent on comparing Run No. 6 with Run No. 4 Table 2 showing the results of Example 1. Dye (D) and the combination of Dyes (D) + (G) in Run No. 6 are described in the German Pat. application (OLS) No. 2,101,071.

Regarding the combination of the sensitizing dyes used in this invention, the reduction in sensitivity and an increase in fog are substantially negligible when the dyes are stored as a mixed solution thereof before use. On the other hand, regarding the combination of a carbocyanine dye with a dimethinemerocyanine dye as described in U.S. Patent No. 3,808,009, a marked increase in fog and an undesirable change in the spectral sensitizing effect are produced when the dyes are stored as a mixed solution thereof before use. Therefore, when the known combination of a carbocyanine dye with a dimethinemerocyanine dye is used, the dyes must be added as separate solutions or mixed immediately before the addition to an emulsion. However, such procedure is troublesome in a practical production process and tends to cause production difficulties. The combination of the dyes according to this invention can be used as a mixed solution without such considerations being of concern.

This invention also exhibits excellent supersensitizing effects when applied to a silver bromoiodide emulsion used for black and white or color light-sensitive materials for photography. This is apparent from Table 5 and Table 6 showing the results of Example 3. Run No. 2 in Table 6 uses the dye combination described in U.S. Pat. No. 3,667,960, which combination is known as a conventionally useful means for spectral sensitization in the red wavelength region.

This invention can be used to shift the sensitization maximum to a shorter wavelength than that obtained with a carbocyanine dye alone, where the spectral sensitivity is not deteriorated. This is apparent on comparing Curve 20 with Curve 21 in Figure 10 or Curve 1 with Curve 3 in Figure 1, these curves showing the spectral sensitivity characteristics. The combination of a carbocyanine dye with a styryl dye as described in U.S. Pat. No. 3,667,960 can be used to shift the sensitization maximum to a shorter wavelength than that obtained with carbocyanine dye alone. In this case, however, the supersensitizing effect is low, and the resulting sensitivity in the red wavelength region is not very high. Silver halide light-sensitive emulsions having a sensitization maximum at a shorter wavelength than that obtained with a conventional carbocyanine dyes, as obtained according to this invention, provide good color reproducibility or color sensitivity when used for a red-sensitive layer of a color light-sensitive material or for a black and white light-sensitive material for photography.

While the invention has been described in detail and with reference to specific embodiments thereof, it will be apparent to one skilled in the art that various changes and modifications can be made therein without departing from the spirit and scope thereof.

What is claimed is:

1. A spectrally sensitized silver halide photographic emulsion containing, in combination, supersensitizing amounts of at least one sensitizing dye represented by the following general formula (I)

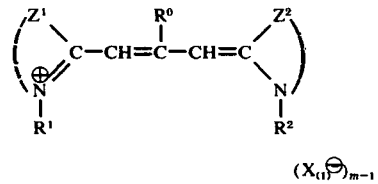

(I)

wherein $Z^1$ and $Z^2$ each represents an atomic group necessary for completing a benzimidazole nucleus, an oxazole nucleus, a benzoxazole nucleus, a naphthoxazole nucleus, a benzothiazole nucleus, a naphthothiazole nucleus, a benzoselenazole nucleus or a naphthoselenazole nucleus excepting that both of $Z^1$ and $Z^2$ do not simultaneously represent an oxazole nucleus, a benzoxazole nucleus or a naphthoxazole nucleus; $R^1$ and $R^2$ each represents an aliphatic group one of which is a sulfoalkyl group, a hydroxyalkyl group or a carboxyalkyl group and the carbon chain of which may be interrupted with an oxygen atom or a sulfur atom; $R^0$ represents a hydrogen atom, an alkyl group or an aralkyl group; $X_{(1)}^{\ominus}$ represents an anion; and m is 1 or 2, with m being 1 when the dye forms an intramolecular salt; and at least one sensitizing dye represented by the following general formula (II)

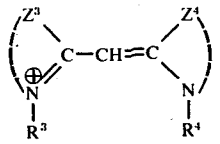

(II)

$(X_{(2)}^{-})_{n-1}$ wherein $Z^3$ and $Z^4$ each represents an atomic group necessary for completing a pyrroline nucleus, a pyridine nucleus, an indolenine nucleus, a benzimidazole nucleus, an oxazole nucleus, a benzoxazole nucleus, a naphthoxazole nucleus, a thiazoline nucleus, a thiazole nucleus, a benzothiazole nucleus, a naphthothiazole nucleus, a selenazole nucleus, a benzoselenazole nucleus or a naphthoselenazole nucleus; $R^3$ and $R^4$ each represents an aliphatic group and the carbon chain of which may be interrupted with an oxygen atom or a sulfur atom, and at least one of $R^3$ and $R^4$ represents an aliphatic group containing a hydroxy group, a carboxy group or a sulfo group; $X_{(2)}^{-}$ represents an anion; and n is 1 or 2, with n being 1 when the dye forms an intramolecular salt.

2. The spectrally sensitized silver halide photographic emulsion of claim 1, wherein the heterocyclic nucleus completed by $Z^1$ and the heterocyclic nucleus completed by $Z^2$ are a naphtho[1,2-d]thiazole nucleus, and $R^3$ represents a methyl group or an ethyl group.

3. The spectrally sensitized silver halide photographic emulsion of claim 1, wherein the heterocyclic nucleus completed by $Z^1$ and the heterocyclic nucleus completed by $Z^2$ are a benzothiazole nucleus or benzoselenazole nucleus, which nuclei may be unsubstituted or substituted in the 5-position with a chlorine atom, a methyl group, a methoxy group or a phenyl group; and $R^3$ represents a methyl group or an ethyl group.

4. The spectrally sensitized silver halide photographic emulsion of claim 1, wherein the heterocyclic nucleus completed by $Z^1$ is benzoxazole nucleus which may be unsubstituted or substituted in the 5-position with a chlorine atom, a methyl group or a methoxy group, and the heterocyclic nucleus completed by $Z^2$ is a benzothiazole nucleus or a benzoselenazole nucleus.

5. The spectrally sensitized silver halide photographic emulsion of claim 1, wherein the heterocyclic nucleus completed by $Z^1$ is a benzimidazole nucleus which is substituted in the 5-position with a chlorine atom, and the heterocyclic nucleus completed by $Z^2$ is a benzoxazole which is substituted in the 5-position with a fluorine atom, a chlorine atom, a methyl group, a methoxy group or a phenyl group.

6. The spectrally sensitized silver halide photographic emulsion of claim 1, wherein the heterocyclic nucleus completed by $Z^1$ is a benzimidazole nucleus which is substituted in the 5- and 6-positions with a chlorine atom, and the heterocyclic nucleus completed by $Z^2$ is a benzoxazole nucleus which is substituted in the 5-position with a phenyl group, a methyl group, a methoxy group, a chlorine atom or a fluorine atom.

7. The spectrally sensitized silver halide photographic emulsion of claim 1, wherein the heterocyclic nucleus completed by $Z^1$ and the heterocyclic nucleus completed by $Z^2$ are a benzimidazole nucleus which is substituted in the 5- and 6-positions with a chlorine atom.

8. The spectrally sensitized silver halide photographic emulsion of claim 1, wherein the heterocyclic nucleus completed by $Z^3$ and the heterocyclic nucleus completed by $Z^4$ are a benzothiazole nucleus or a benzoselenazole nucleus, which nuclei may be unsubstituted or substituted in the 5-position with a chlorine atom, a methyl group or a methoxy group.

9. The spectrally sensitized silver halide photographic emulsion of claim 1, wherein one of the heterocyclic nucleus completed by $Z^3$ and the heterocyclic nucleus completed by $Z^4$ is a naphtho[1,2-d]thiazole nucleus or a naphtho[1,2-d]selenazole nucleus.

10. The spectrally sensitized silver halide photographic emulsion of claim 1, wherein the heterocyclic nucleus completed by $Z^3$ and the heterocyclic nucleus completed by $Z^4$ are a benzothiazole nucleus, a benzoselenazole nucleus or a naphtho[1,2-d]thiazole nucleus.

11. The spectrally sensitized silver halide photographic emulsion of claim 1, wherein at least one of $R^1$ and $R^2$ represents a sulfoalkyl group, a hydroxyalkyl group or a carboxyalkyl group.

12. The spectrally sensitized silver halide photographic emulsion of claim 1, wherein at least one of $R^4$ and $R^5$ represents a sulfoalkyl group or a carboxyalkyl group.

13. The spectrally sensitized silver halide photographic emulsion of claim 1, wherein one of the heterocyclic nucleus completed by $Z^3$ and the heterocyclic nucleus completed by $Z^4$ is a naphtho[1,2-d]thiazole nucleus or a naphtho[1,2-d]selenazole nucleus, and the other nucleus is a benzothiazole nucleus or a benzoselenazole nucleus.

14. The spectrally sensitized silver halide photographic emulsion of claim 1, wherein the sensitization is by adding a mixed solution of at least one dye represented by the general formula (I) and at least one dye represented by the general formula (II).

15. The spectrally sensitized silver halide photographic emulsion of claim 14, wherein the adding of the mixed solution is after storage for a period of 1 hour to 6 days.

16. A light-sensitive material comprising a support having thereon at least one layer comprising the silver halide photographic emulsion of claim 1.

17. The light-sensitive material of claim 16, wherein the silver halide emulsion is panchromatically color sensitized.

18. The light-sensitive material of claim 16, wherein the silver halide emulsion is orthochromatically color sensitized.

19. A lithographic light-sensitive material comprising a support containing thereon a layer comprising the silver halide photographic emulsion of claim 1.

20. A multi-layer color light-sensitive material comprising a support having thereon at least one layer comprising the silver halide photographic emulsion of claim 1 as a red-sensitive layer.

* * * * *